US008967612B2

(12) United States Patent
Yokote

(10) Patent No.: US 8,967,612 B2
(45) Date of Patent: Mar. 3, 2015

(54) MEDIUM PROCESSING DEVICE

(71) Applicant: Oki Electric Industry Co., Ltd., Tokyo (JP)

(72) Inventor: Takamoto Yokote, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 14/129,509

(22) PCT Filed: Sep. 25, 2012

(86) PCT No.: PCT/JP2012/074567
§ 371 (c)(1),
(2) Date: Dec. 26, 2013

(87) PCT Pub. No.: WO2013/073291
PCT Pub. Date: May 23, 2013

(65) Prior Publication Data

US 2014/0191466 A1 Jul. 10, 2014

(30) Foreign Application Priority Data

Nov. 18, 2011 (JP) ..... 2011-252916

(51) Int. Cl.

| | |
|---|---|
| ***B65H 5/02*** | (2006.01) |
| ***B65H 5/22*** | (2006.01) |
| ***B65H 5/00*** | (2006.01) |
| ***G07D 11/00*** | (2006.01) |
| ***B65H 29/00*** | (2006.01) |

(52) U.S. Cl.

CPC ..... *B65H 5/00* (2013.01); *G07D 11/0081* (2013.01); *B65H 29/006* (2013.01); *B65H 2301/419* (2013.01); *B65H 2402/441* (2013.01); *B65H 2403/40* (2013.01); *B65H 2403/944* (2013.01); *B65H 2407/11* (2013.01); *B65H 2407/20* (2013.01); *B65H 2701/1912* (2013.01)

USPC ..... 271/3.01; 271/3.03; 271/273

(58) Field of Classification Search

USPC ..... 271/3.01, 3.03, 273

See application file for complete search history.

(56) References Cited

U.S. PATENT DOCUMENTS

| | | | | |
|---|---|---|---|---|
| 6,139,011 | A * | 10/2000 | Huang et al. | 271/274 |
| 6,578,845 | B2 * | 6/2003 | Chen | 271/273 |
| 2002/0145250 | A1 * | 10/2002 | Chen | 271/273 |
| 2006/0214350 | A1 * | 9/2006 | Saltsov et al. | 271/3.01 |
| 2008/0150216 | A1 * | 6/2008 | Ichikawa et al. | 271/3.01 |

FOREIGN PATENT DOCUMENTS

| | | | |
|---|---|---|---|
| JP | 3207504 | B2 | 9/2001 |
| JP | 2011-134222 | A | 7/2011 |

* cited by examiner

*Primary Examiner* — David H Bollinger
(74) *Attorney, Agent, or Firm* — Rabin & Berdo, P.C.

(57) ABSTRACT

A medium processing device includes holding section that temporarily retains a medium therein. A gear inside the holding section drives a mechanism that stores the medium into and feeds out from the holding section. A main body includes a mounting location at which the holding section is mounted, and transfers the medium to and from the holding section at a time at which the holding section is mounted. An operation knob transmits, to the gear, a rotary operation applied from outside the holding section. An operation restriction portion at the main body, blocks transmission of the rotary operation from the knob to the gear in a mounted state in which the holding section is mounted at the mounting location, and allows transmission of the rotary operation from the knob to the gear in a detached state in which the holding section is detached.

11 Claims, 17 Drawing Sheets

MEDIUM PROCESSING DEVICE

TECHNICAL FIELD

The present application claims priority over Japanese Patent Application No. 2011-252916, filed on Nov. 18, 2011, the disclosure of which is incorporated herein by reference in its entirety.

The present invention relates to a medium processing device, and particularly relates to an automatic teller machine (ATM) or the like, into which a medium such as, for example, banknotes is deposited and that conducts desired transactions.

BACKGROUND ART

Heretofore, an ATM or the like that is used in financial institutions is configured such that, in accordance with the details of a transaction with a customer, cash—for example, banknotes and coins—is deposited by the customer or cash is withdrawn by the customer.

An ATM has been proposed (for example, see FIG. 1 of Japanese Patent No. 3,207,504) that includes: a banknote input/output port for transferring banknotes to and from, for example, customers; a verification section that verifies the denominations of deposited banknotes and whether the banknotes are authentic; a temporary holding section that temporarily retains the deposited banknotes; and denomination cassettes that store the banknotes of the respective denominations.

In a deposit transaction, when a customer deposits banknotes in the banknote input/output port, this ATM verifies the deposited banknotes at the verification section, and retains banknotes that are verified as being authentic in the temporary holding section. Meanwhile, banknotes that are verified as not being suitable for the transaction are returned to the banknote input/output port and returned to the customer. Then, when the customer has confirmed a deposit amount, the ATM re-verifies the denominations of the banknotes retained in the temporary holding section at the verification section, and stores the banknotes in the denomination cassettes in accordance with the verified denominations.

Among ATMs, there is an ATM with a structure in which the temporary holding section can be withdrawn from the main body of the ATM, so as to improve the work efficiency of maintenance operations.

For example, as illustrated in FIG. 16A, in an ATM 200, a frame 20 of a temporary holding section 215 is mounted at a main body frame 211F. The interior of the main body frame 211F is structured such that banknotes are transferred between a conveyance section 13 that conveys the banknotes and a transfer aperture 23 of the temporary holding section 215.

At the ATM 200, as illustrated in FIG. 16B, a portion of the conveyance section 13, the transfer aperture 23 of the temporary holding section 215 and suchlike are exposed to the exterior during maintenance operations, by the frame 20 of the temporary holding section 215 being turned about a turning shaft 22. Thus, the efficiency of maintenance operations may be improved.

Hereinafter, a state in which the temporary holding section 215 is mounted to the main body frame 211F and banknotes BL can be transferred (FIG. 16A) is referred to as "the mounted state", and a state in which the temporary holding section 215 is turned and removed from the main body frame 211F to expose the transfer aperture 23 and the like (FIG. 16B) is referred to as "the detached state".

When the temporary holding section 215 receives a banknote from the main body frame 211F side, conveyance rollers 24 and the like are rotated and the banknote is conveyed along a conveyance path 26, and is wound onto a periphery side face of a drum 27 with a tape, which is not illustrated in the drawings.

An operation knob 221 for maintenance operations is provided at the temporary holding section 215. A gear, which is not illustrated in the drawings, is provided at the operation knob 221. The temporary holding section 215 is structured such that, when the gear is pushed in into the frame 20, the gear temporarily meshes with another gear or the like inside the temporary holding section 215, and the drum 27, the conveyance rollers 24 and the like (shown by broken lines in the drawings) inside the temporary holding section 215 may be operated by hand.

SUMMARY OF INVENTION

Technical Problem

In this temporary holding section 215, if the operation knob 221 is rotated in a predetermined direction in the state in which a banknote is wound onto the drum 27 during maintenance operations, the banknote is conveyed along the conveyance path 26 to the transfer aperture 23.

If the temporary holding section 215 is in the detached state (FIG. 16B) at this time, the banknote may be fed out from the transfer aperture 23, and this banknote may be retrieved by a maintenance technician or the like.

On the other hand, if the temporary holding section 215 is in the mounted state (FIG. 16A), because the conveyance section 13 in the main body frame 211F is not operating, the banknote reaching the transfer aperture 23 may not be fed out and may become jammed in the conveyance path 26 or the like.

When this happens, as illustrated in FIG. 17, banknotes may be successively jammed in the conveyance path 26 of the temporary holding section 215, and there is a risk of damage to the mechanisms, tape (not illustrated in the drawings) and the like in the temporary holding section 215, and also of damage to the banknotes.

Thus, in the ATM 200, if the operation knob 221 is operated in the state in which the temporary holding section 215 is mounted to the main body frame 211F, banknotes may become jammed in the conveyance path 26 and the like inside the temporary holding section 215, or mechanisms, banknotes and the like may be damaged.

The present invention has been made in consideration of the problem described above, and a medium processing device that may prevent damage to the device and the medium during maintenance operations is proposed.

Solution to Problem

A present aspect of the medium processing device for solving this problem is provided with: a temporary holding section that temporarily retains a medium therein; a gear that is provided inside the temporary holding section, and that drives a mechanism that stores the medium into the temporary holding section and feeds out the medium from inside the temporary holding section; a main body that includes a mounting location at which the temporary holding section is mounted, and that transfers the medium to and from the temporary holding section at a time at which the temporary holding section is mounted at the mounting location; an operation knob that transmits, to the gear, a rotary operation applied from outside of the temporary holding section; and an operation restriction portion that is provided at the main body, that blocks transmission of the rotary operation from the operation knob to the gear in a mounted state in which the temporary holding section is mounted at the mounting location of the main body, and that allows transmission of the rotary operation from the operation knob to the gear in a detached state in which the temporary holding section is detached from the mounting location.

Thus, the transmission of rotation from the operation knob to the gear may be blocked by the operation restriction portion when the temporary holding section is in the mounted state, whereas a rotation may be transmitted from the operation knob to the gear when the temporary holding section is in the detached state, and the gear may be driven via the operation knob.

In the present aspect, the operation knob includes a gearwheel, the gearwheel of the operation knob meshing with the gear by being moved to a predetermined meshing position, and the meshing with the gear being released by the operation knob being moved to a withdrawn position that is distant from the meshing position; and the operation restriction portion blocks the transmission of the rotary operation from the operation knob to the gear in the mounted state by keeping the operation knob at the withdrawn position, and allows movement of the operation knob to the meshing position in the detached state.

In the present aspect, the operation restriction portion may keep the operation knob at the withdrawn position in the mounted state by engaging with the operation knob.

In the present aspect, the operation restriction portion may keep the operation knob at the withdrawn position in the mounted state by covering the operation knob and preventing operation of the operation knob from outside.

In the present aspect, the operation restriction portion may keep the operation knob at the withdrawn position in the mounted state by being disposed between the withdrawn position and the meshing position of the operation knob.

In the present aspect, in the mounted state, the operation restriction portion may engage with the operation knob at plural locations around a rotation axis of the operation knob.

In the present aspect, the temporary holding section includes: a drum, on a peripheral face of which the medium is wound; and a conveyance section that conveys the medium between the drum and the main body, the gear includes: a drum gear that transmits driving force from a predetermined drum motor to the drum; and a conveyance gear that transmits driving force from a predetermined conveyance motor to the conveyance section without transmitting driving force from the drum motor, during non-operation of the operation knob while the rotary operation is not being applied from outside the temporary holding section, the operation knob does not transmit the rotary operation to the drum gear and/or the conveyance gear, and, during operation of the operation knob while the rotary operation is being applied from outside the temporary holding section, the operation knob transmits rotary operation to both the drum gear and the conveyance gear.

Effects of Invention

According to the present aspect, when the temporary holding section is in the mounted state, the transmission of rotation from the operation knob to the gear may be blocked by the operation restriction portion, whereas when the temporary holding section is in the detached state, rotation may be transmitted from the operation knob to the gear and the gear may be driven via the operation knob. Thus, according to the present aspect, a medium processing device that may prevent damage to the device and the medium during maintenance operations may be embodied.

DESCRIPTION OF EMBODIMENTS

Herebelow, embodiments for implementing the invention (referred to as embodiments hereinafter) are described using the attached drawings.

1. First Embodiment

1-1. Overall Structure of Automatic Teller Machine

Figure 1:
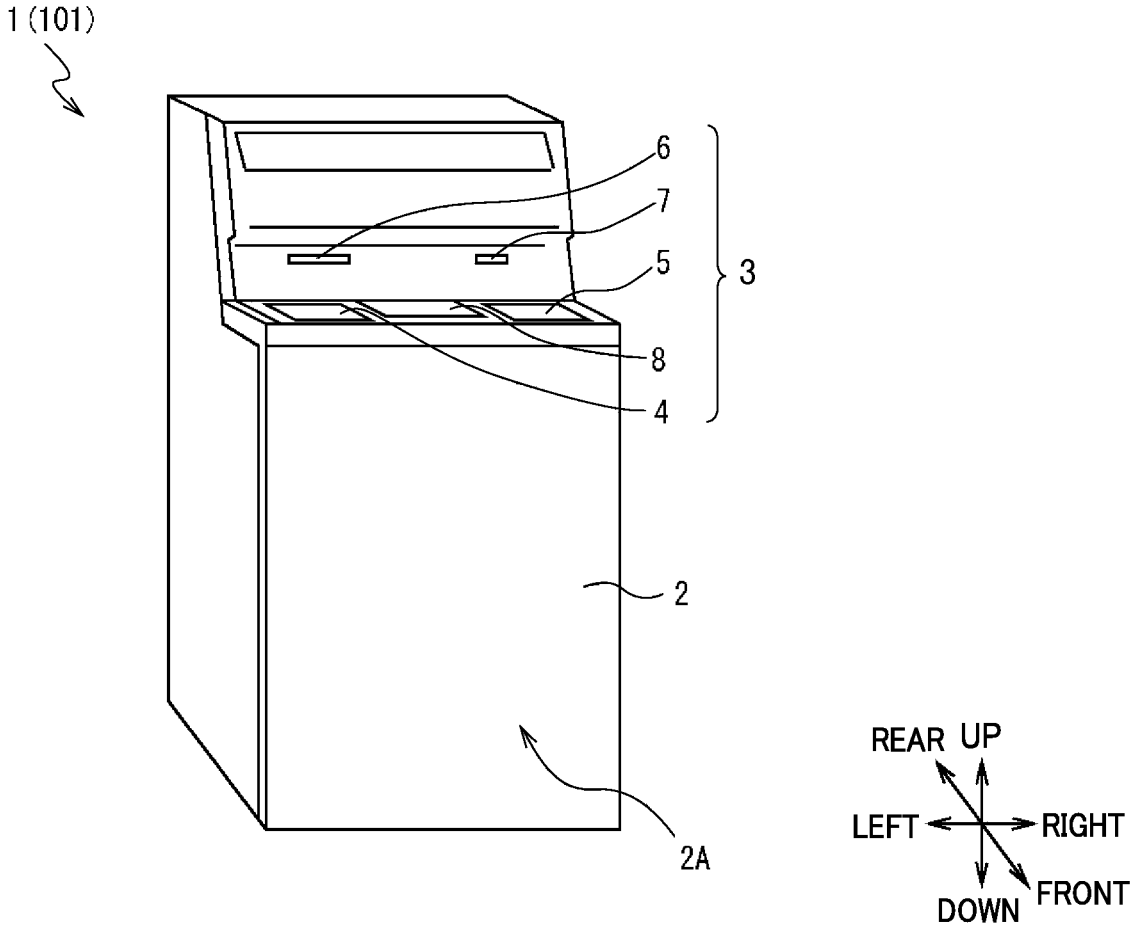
FIG. 1 is a schematic perspective view illustrating external structures of an ATM.

As the external appearance is illustrated in FIG. 1, an ATM 1 is basically structured by a box-shaped casing 2, and is configured to conduct transactions relating to cash with customers.

The casing 2 is provided with a customer service section 3 at a location at which insertions of banknotes, operations of a touch panel are easy in a state in which a customer is stood at the side of a front face 2A of the casing 2. That is, the customer service section 3 is provided at a portion extending from an upper portion of the front face 2A to an upper face of the casing 2.

The customer service section 3 is configured to implement direct transfers of cash, bank books and the like to and from customers, and to give notification of information relating to transactions, accept operational instructions. The customer service section 3 is provided with a coin input/output port 4, a banknote input/output port 5, a bank book insertion port 6, a card insertion port 7, and a display/operation section 8.

The coin input/output port 4 and the banknote input/output port 5 are section into which coins and banknotes BL that customers are depositing are respectively input, and from which coins and banknotes BL that customers are withdrawing are respectively fed out. The coin input/output port 4 and the banknote input/output port 5 are opened and closed by driving respective shutters provided thereat. The banknotes BL are formed as, for example, rectangular pieces of paper.

The bank book insertion port 6 is a section into which bank books that are to be used in transactions are inserted and from which the bank books are fed out when transactions are finished. A bank book processing section (not illustrates in the drawings) that records transaction details and the like in bank books is provided behind the bank book insertion port 6.

The card insertion port 7 is a section into which various kinds of cards such as cash cards are inserted and from which the cards are fed out. A card processing section (not illustrated in the drawings) that reads magnetically recorded account numbers and the like on the various cards is provided behind the card insertion port 7.

In the display/operation section 8 a liquid crystal display (LCD), which displays operation screens during transactions, is integrated with a touch panel, at which selections of types of transaction, PIN numbers, transaction amounts and the like are entered.

The casing 2 is structured with doors that are capable of opening and closing portions of side faces such as the front face 2A or the opposite side face of the front face 2A (that is, a rear face side). That is, during transaction operations in which the ATM 1 is conducting transactions relating to cash with customers, the casing 2 protects banknotes BL, coins retained therein by the doors being closed. During maintenance operations in which technicians are conducting maintenance operations, operations of the respective sections inside the casing 2 may be performed easily by the doors being opened as necessary.

Hereinafter, descriptions are given by defining the front face 2A side of the ATM 1 as a front side, the opposite side as a rear side, the left and right as viewed by a customer standing at the front face 2A side of the ATM 1 as a left side and right side, and by defining an upper side and lower side.

Figure 2:
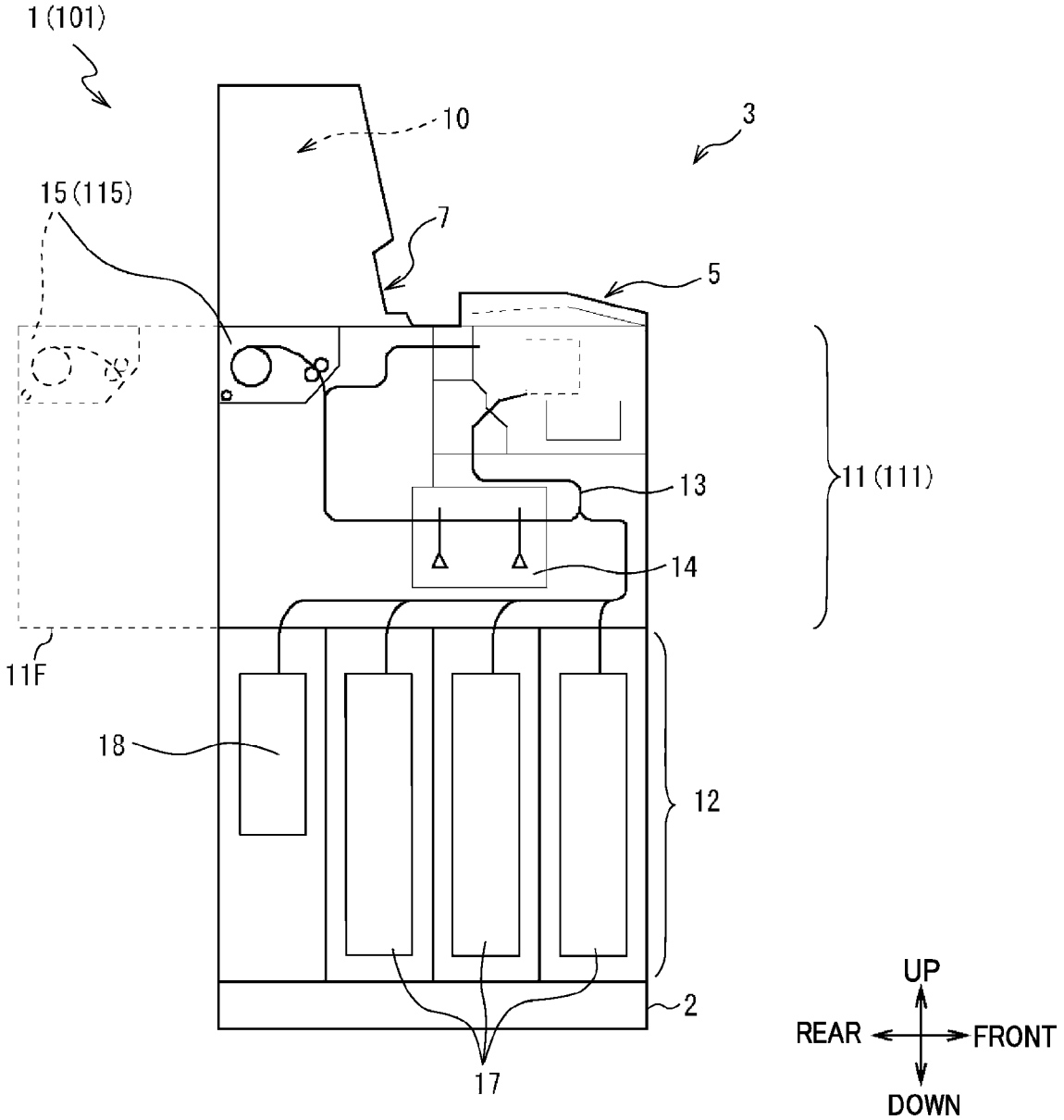
FIG. 2 is a schematic view illustrating internal structures of the ATM.

FIG. 2 is a side view in which the ATM 1 of FIG. 1 is viewed from the left side. FIG. 2 illustrates portions of internal structures of the ATM 1 that principally relate to the processing of banknotes. As illustrated in FIG. 2, a banknote processing section 11 that performs various kinds of processing of banknotes BL is provided at the upper side of the interior of the ATM 1, and a banknote storage section 12 that stores the banknotes BL is provided at the lower side of the interior of the ATM 1.

The banknote input/output port 5 that is a portion of the customer service section 3; a verification section 14 that verifies denominations, authenticity and the like of the banknotes BL; a temporary holding section 15 that temporarily retains deposited banknotes; and so forth are provided inside the banknote processing section 11.

A conveyance section 13 is provided inside the banknote processing section 11, which conveys the banknotes BL along a predetermined conveyance path (shown by heavy lines in the drawing) between the respective sections of the banknote processing section 11, with a short side direction of the banknotes BL oriented in the traveling direction.

Banknote storages 17 that separately store the banknotes BL by the denominations, and a reject storage 18 that stores banknotes BL that have been verified as not being suitable for distribution due to damage or the like, are provided in the banknote storage section 12.

The ATM 1 is collectively controlled as a whole by a control section 10. When, for example, a customer is performing a deposit transaction to deposit banknotes BL, the control section 10 receives predetermined operational inputs via the display/operation section 8 (FIG. 1), after which the ATM 1 opens the shutter of the banknote input/output port 5 and the banknotes BL are deposited therein.

Then, the control section 10 conveys the deposited banknotes BL to the verification section 14 via the conveyance section 13, and the verification section 14 verifies the banknotes BL. Banknotes BL that are verified as being proper banknotes are conveyed to the temporary holding section 15 and temporarily retained thereat, whereas banknotes BL that are verified as being unsuitable for the transaction are conveyed to the banknote input/output port 5 and returned to the customer.

The control section 10A confirms a deposit amount with the customer via the display/operation section 8, and conveys the banknotes BL retained at the temporary holding section 15 back to the verification section 14 to re-verify the denominations thereof, and then conveys the banknotes BL to the banknote storage section 12.

The banknote storage section 12 conveys banknotes BL that are identified by the verification section 14 as being undamaged to the respective banknote storages 17 corresponding to the denominations thereof, and stores these banknotes BL therein. The banknote storage section 12 also conveys banknotes BL that are identified by the verification section 14 as being damaged to the reject storage 18 and stores these banknotes BL therein.

1-2. Structure of the Temporary Holding Section

Figure 3:
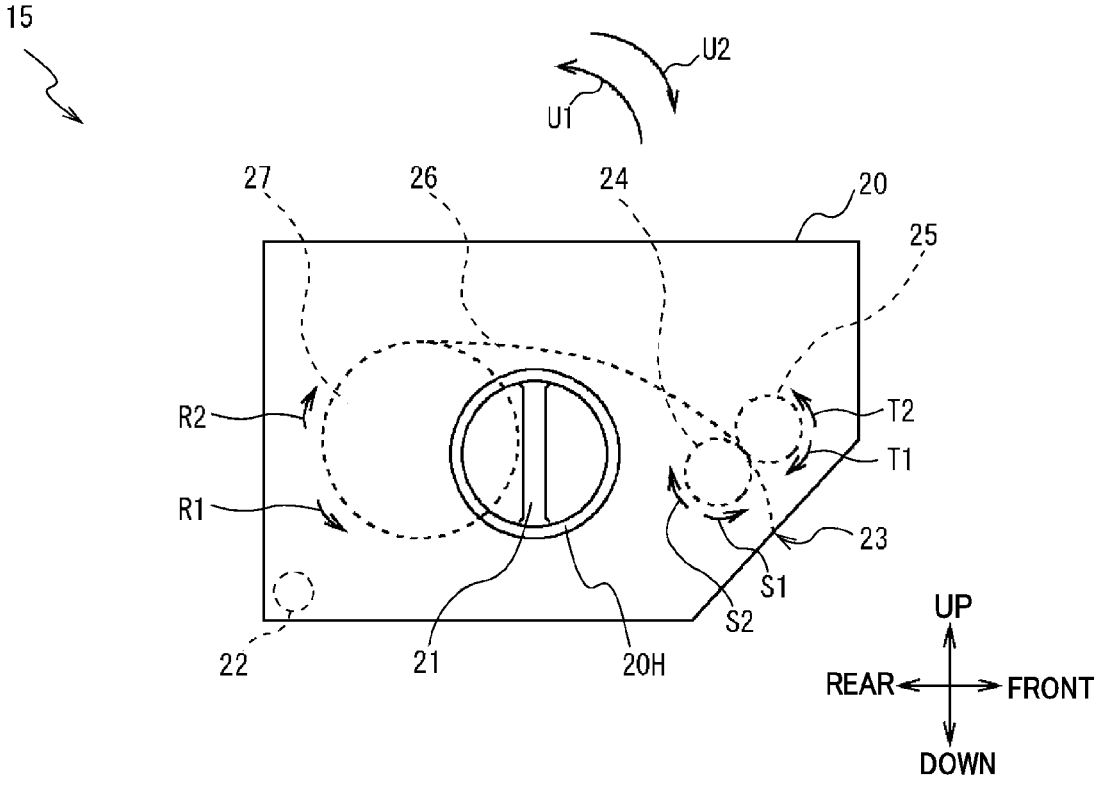
FIG. 3 is a schematic side view illustrating structures of a temporary holding section.

As illustrated in a side view in FIG. 3, the temporary holding section 15 is structured by respective members that are disposed inside the frame 20, which forms an outer shell of the temporary holding section 15. An operation knob 21 is exposed through a hole portion 20H that is formed in a left side face of the frame 20.

When the temporary holding section 15 receives a banknote BL from the conveyance section 13 of the banknote processing section 11 (FIG. 2) via the transfer aperture 23, the banknote BL is caused to travel rearward along a conveyance path 26 by conveyance rollers 24 rotating in the direction of arrow S1, driven rollers 25 rotating in the direction of arrow T1 to follow the rotation of the conveyance rollers 24, and the like.

The temporary holding section 15 is configured to successively store the banknotes BL by rotating a drum 27, which has a cylindrical shape, in the direction of arrow R1 and winding the banknotes BL onto the outer periphery of the drum 27 together with a tape (not illustrated in the drawings).

When the temporary holding section 15 receives an instruction from the control section 10 (FIG. 2) to feed out a banknote BL, the temporary holding section 15 unwinds the banknote BL that has been wound onto the periphery face of the drum 27, together with the tape, by rotating the drum 27 in the direction of arrow R2, and transfers the banknote BL to the conveyance path 26.

Then, the temporary holding section 15 causes the banknote BL to travel in the forward direction along the conveyance path 26 by rotating the conveyance rollers 24 and the driven rollers 25 in the directions of arrows S2 and T2, respectively, and transfers the banknote BL through the transfer aperture 23 to the conveyance section 13 of the banknote processing section 11.

The temporary holding section 15 is configured to be capable of turning about a turning shaft 22 (FIG. 3), which is arranged along the left-right direction, in the direction of arrow U1 or in the direction of arrow U2 relative to a banknote processing section frame 11F (FIG. 2) of the banknote processing section 11.

Figure 16A:
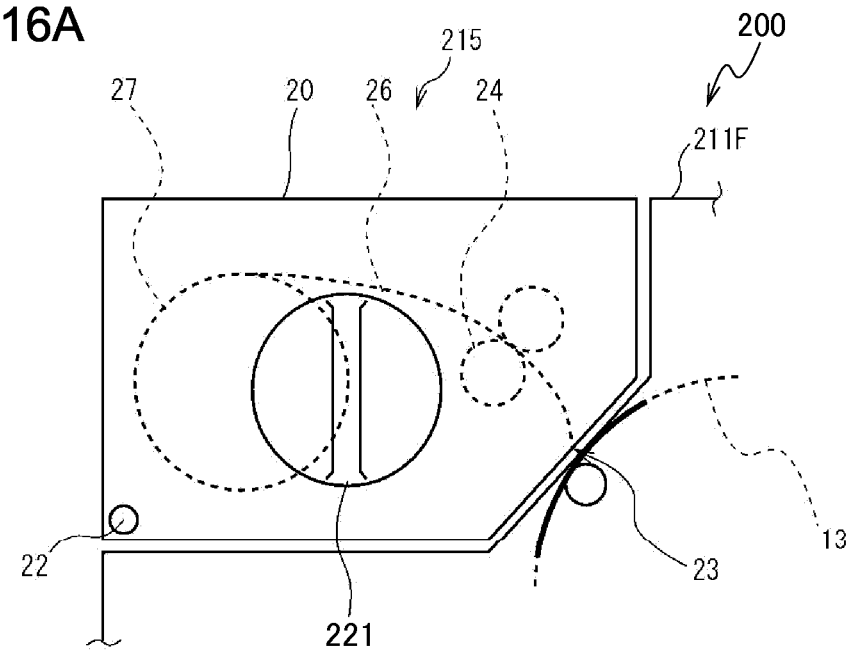
FIG. 16A is a schematic view illustrating the structure of a conventional temporary holding section in the mounted state.
Figure 16B:
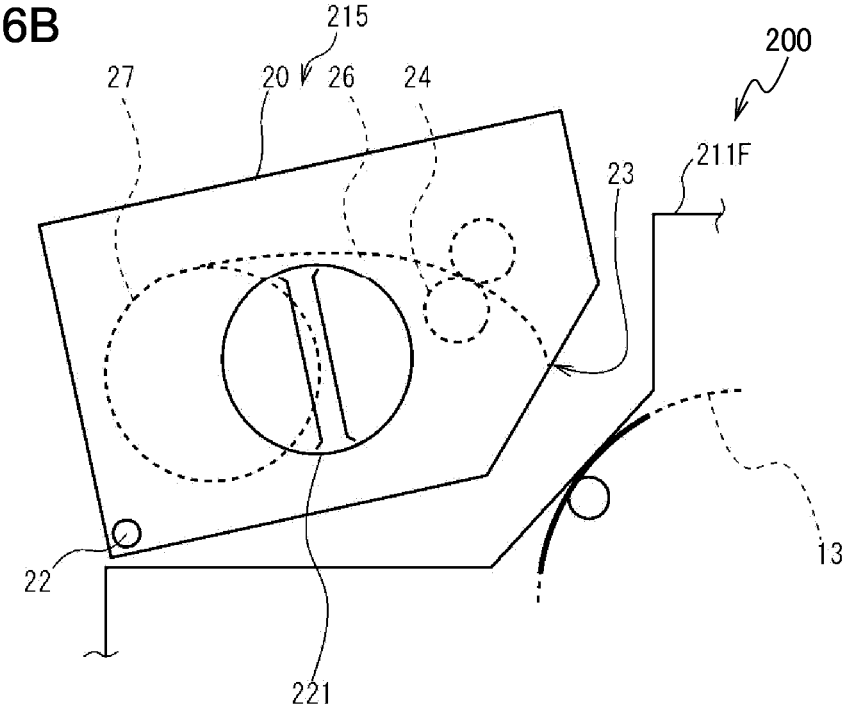
FIG. 16B is a schematic view illustrating the structure of the conventional temporary holding section in the detached state.
Figure 17:
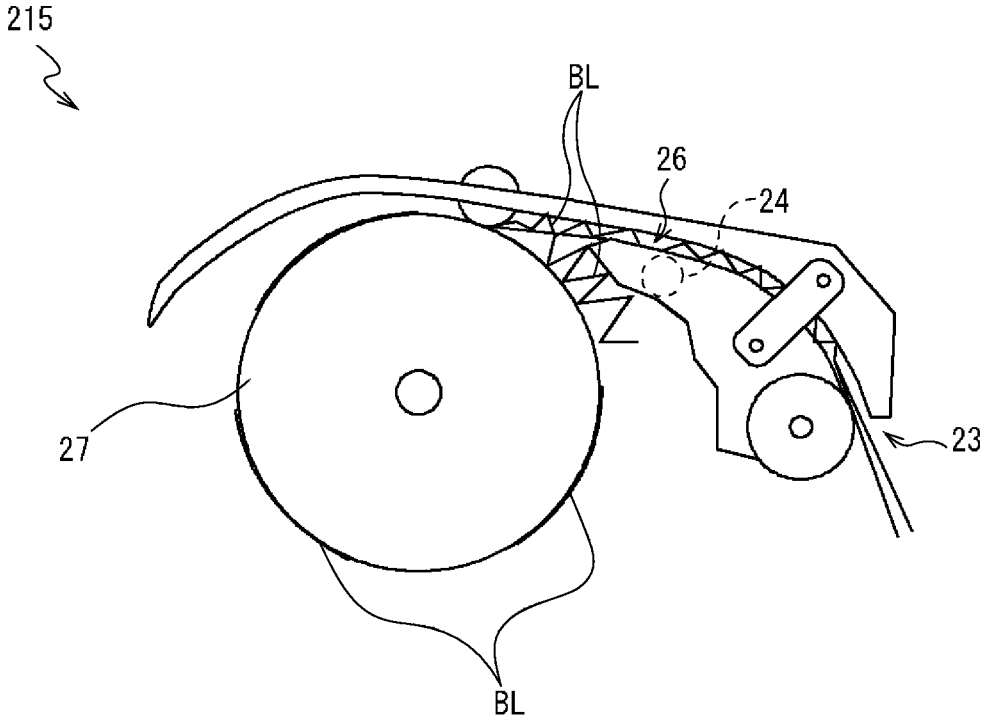
FIG. 17 is a schematic view supporting a description of jamming of banknotes in the conventional temporary holding section.

That is, similarly to the conventional temporary holding section 215, the temporary holding section 15 may be switched between the mounted state (FIG. 16A), in which the temporary holding section 15 is mounted at the banknote processing section frame 11F, and the detached state (FIG. 16B), in which the temporary holding section 15 is removed from the banknote processing section frame 11F, by being turned about the turning shaft 22.

Figure 4:
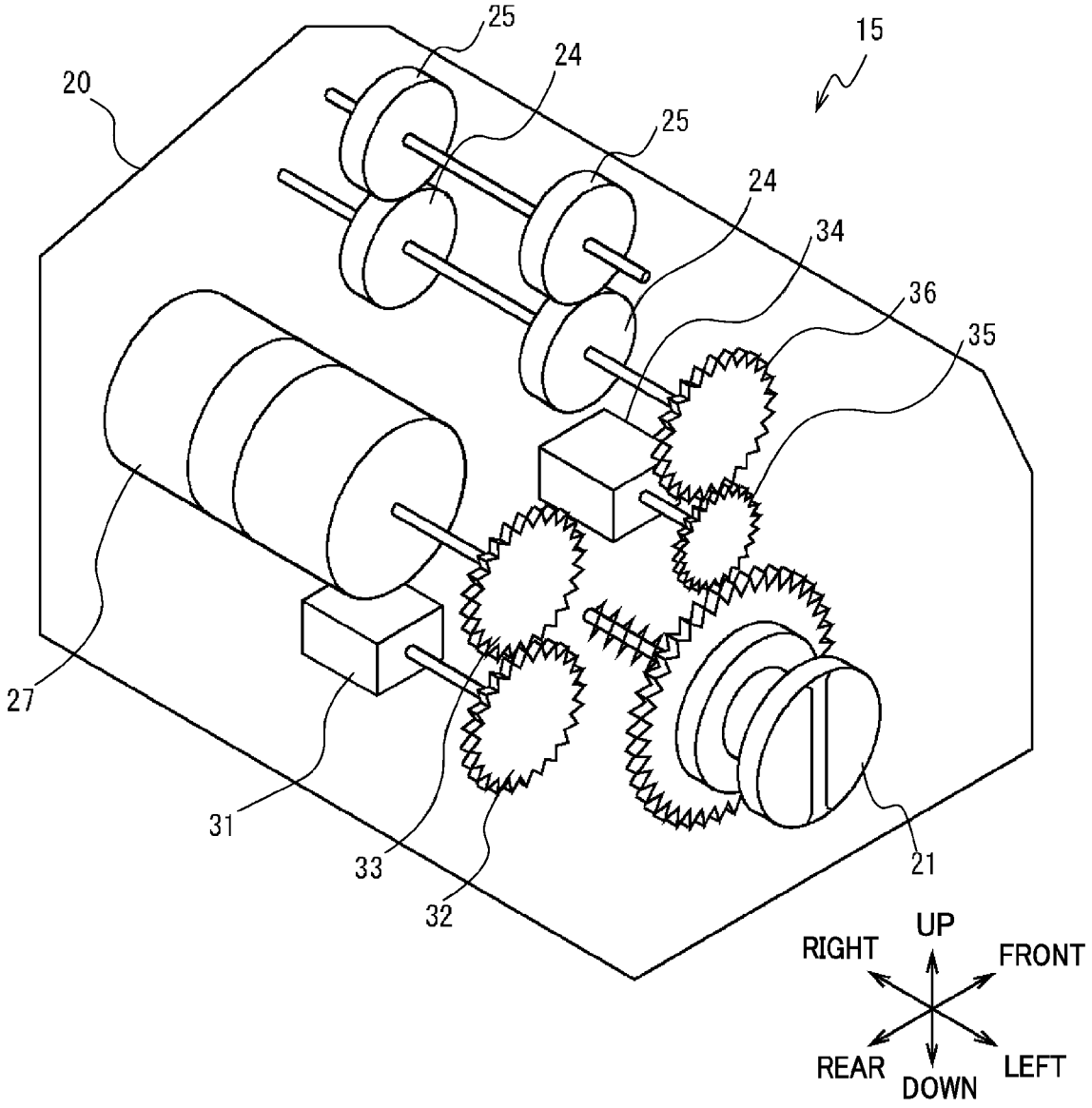
FIG. 4 is a schematic perspective view illustrating the structures of the temporary holding section.

As illustrated in the schematic perspective view in FIG. 4, in addition to the above-mentioned drum 27, conveyance rollers 24, a motor as a power source, gearwheels for transmitting driving force and the like are provided inside the temporary holding section 15.

A motor 31 rotates in accordance with control from the control section 10 (FIG. 2). A gear 32 is mounted to an output shaft of the motor 31. The gear 32 meshes with a gear 33, which is mounted to a rotation axle of the drum 27.

According to this structure, the temporary holding section 15 is configured such that, when the motor 31 rotates, rotary driving force is transmitted to the drum 27 via the gear 32 and the gear 33, and the drum 27 is rotated.

A motor 34 rotates in accordance with control from the control section 10 (FIG. 2). A gear 35 is mounted to an output shaft of the motor 34. The gear 35 meshes with a gear 36, which is mounted to a rotation axle of the conveyance rollers 24.

According to this structure, the temporary holding section 15 is configured such that, when the motor 34 rotates, rotary driving force is transmitted to the conveyance rollers 24 via the gear 35 and the gear 36, and the conveyance rollers 24 and the driven rollers 25 are rotated.

In the temporary holding section 15, the drum driving system that transmits driving force from the motor 31 to the drum 27 is separate from the conveyance driving system that transmits driving force from the motor 34 to the conveyance rollers 24, and these systems may be operated respectively independently from one another.

As illustrated in FIG. 4, the operation knob 21 has a form in which plural cylindrical members, gears and the like are layered in the left-right direction.

Figure 5A:
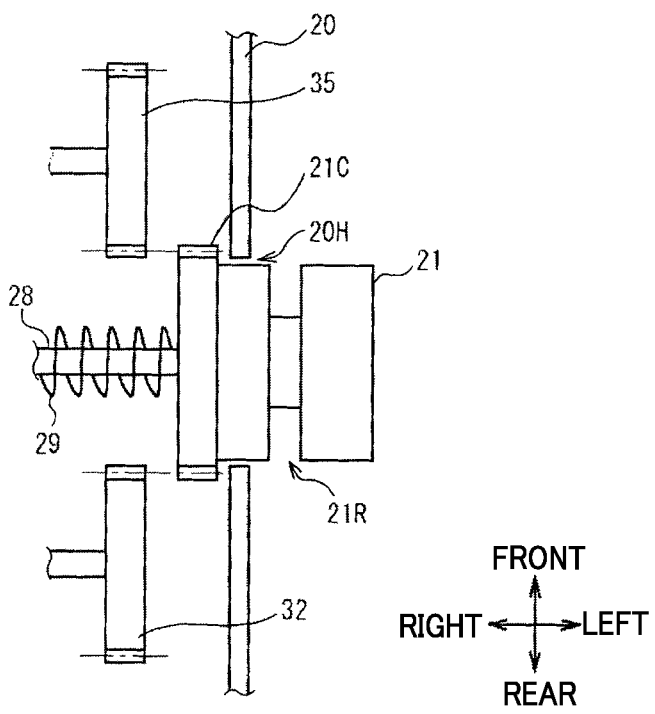
FIG. 5A is a schematic view illustrating structures of an operation knob in accordance with a first embodiment at a withdrawn position.

As illustrated in a plan view in FIG. 5A, the operation knob 21 is generally formed in a circular rod shape, with a central axis along the left-right direction. A slot portion 21R that is constricted to be narrow is formed at an approximately central portion of the operation knob 21 in the left-right direction. A gear portion 21C, which is a spur gear, is mounted at the right end of the operation knob 21 so as to be coaxial with the central axis.

A grip that enables easy gripping with the fingertips is formed by a left side face of the circular rod-shaped portion of the operation knob 21 being indented into a predetermined shape.

The operation knob 21 is mounted to a shaft 28 so as to be coaxial therewith, and may freely rotate about the shaft 28 serving as a rotation axis.

The shaft 28 includes a compression mechanism, which is not illustrated in the drawings. By the overall length of the shaft 28 being compressed, the operation knob 21 may be moved in the left-right direction within a predetermined movement range. A spring 29, which is a coil spring, is fitted around the shaft 28 in a state in which the spring 29 is compressed from the natural length thereof.

According to this structure, in a state in which no external force is applied, such as during usual operation in which usual transaction processing is being performed at the ATM 1, the operation knob 21 is urged leftward by urging force of the spring 29 and, as illustrated in FIG. 5A, the operation knob 21 is in a state that is moved furthest to the left.

In this state, a large portion of the operation knob 21 including the slot portion 21R protrudes to the left side relative to the frame 20, that is, protrudes to the outer side of the frame 20, and the gear portion 21C does not mesh with either of the gears but is withdrawn and is in a free state. Hereinafter, the position of the operation knob 21 in this state is referred to as "the withdrawn position".

Figure 5B:
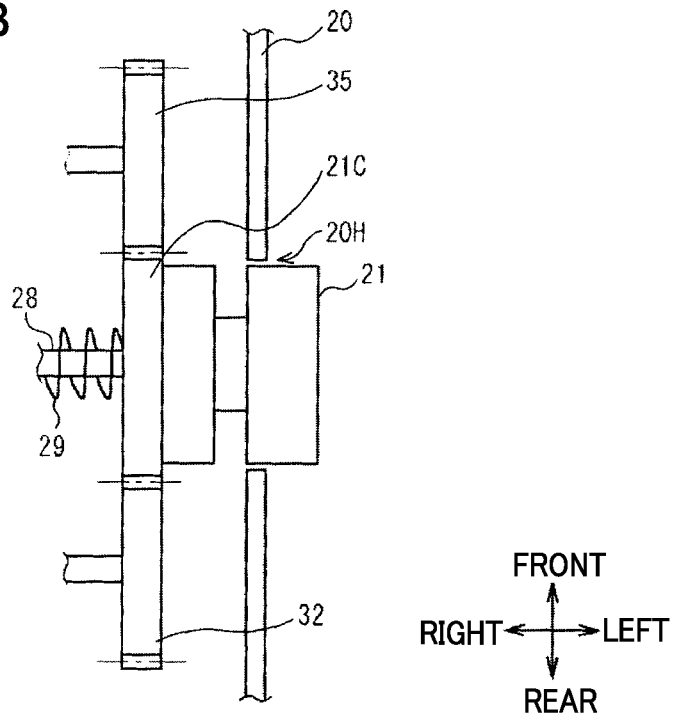
FIG. 5B is a schematic view illustrating the structures of the operation knob in accordance with the first embodiment at a meshing position.

On the other hand, when an external force is applied to the operation knob 21, such as being pushed in the rightward direction, the operation knob 21 moves rightward while compressing the spring 29 and, as illustrated in FIG. 5B, goes to a state in which the operation knob 21 is moved furthest to the right.

In this state, a large portion of the operation knob 21 including the slot portion 21R is depressed to the right side relative to the frame 20, that is, to the inner side of the frame 20, and the gear portion 21C is in a state of being meshed with both the gear 32 and the gear 35. Hereinafter, the position of the operation knob 21 in this state is referred to as "the meshing position".

Hence, if the operation knob 21 is rotated in either direction at the meshing position, the driving force of the rotation may be transmitted to both of the gears 32 and 35, and both the drum 27 and the conveyance rollers 24 and driven rollers 25 may be rotated simultaneously.

In practice, in a state of the temporary holding section 15 in which banknotes BL have been wound onto the periphery face of the drum 27, if the operation knob 21 is put into the depressed state by an operation by a maintenance technician and rotated in a predetermined direction, the drum 27, the conveyance rollers 24 and the driven rollers 25 are simultaneously rotated in the directions of arrow R2, arrow S2 and arrow T2, respectively, and the banknotes BL may be fed out through the transfer aperture 23.

From the depressed state, when the external force to rightward is released, the operation knob 21 is moved in the leftward direction by restoring force of the spring 29, and returns to the protruding state (FIG. 5A).

Thus, the temporary holding section 15 is structured such that, during usual operations, the operation knob 21 is retained at the withdrawn position and the gear portion 21C is unmeshed. On the other hand, during maintenance operations, if the operation knob 21 is pushed into the meshing position, the gear portion 21C meshes with the gears 32 and 35, and a rotary driving force from the operation knob 21 may be transmitted thereto.

1-3. Structure of the Operation Restriction Plate

Figure 6:
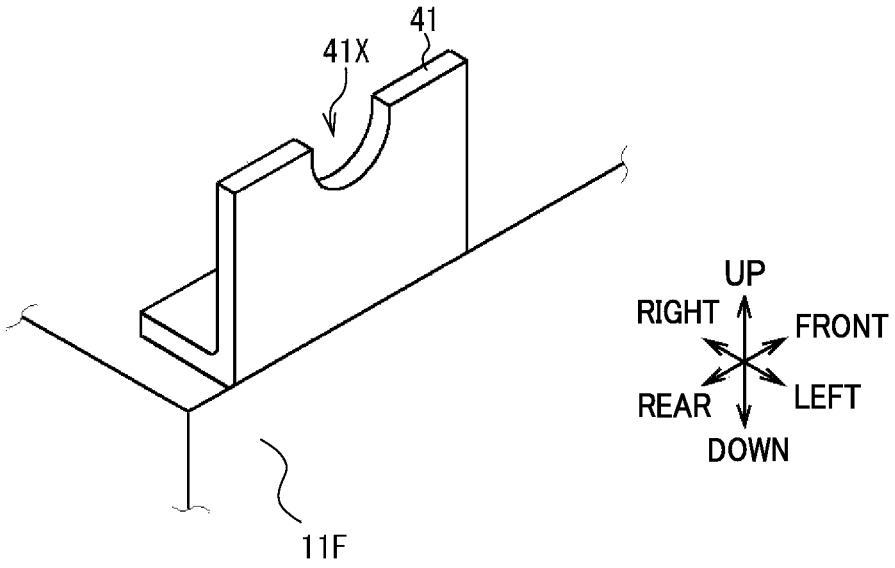
FIG. 6 is a schematic perspective view illustrating the structure of an operation restriction plate in accordance with the first embodiment.

At the banknote processing section 11 (FIG. 2), an operation restriction plate 41 is mounted as illustrated in FIG. 6.

The operation restriction plate 41 is structured by a thick metal plate being bent into a backward "L"-shape as viewed from the rear side. The operation restriction plate 41 is fixed to an upper face at the rear left of the banknote processing section frame 11F that forms the outer shell of the banknote processing section 11, by being screwed thereto.

A cutout portion 41X is formed, by being cut away in a substantial "U"-shape as viewed in the left-right direction, at a vicinity of a front-rear direction central portion of an upper edge of the operation restriction plate 41. An upper portion of the cutout portion 41X is rectangular and a lower portion of the cutout portion 41X is semi-circular.

The diameter of the semi-circle forming the lower portion of the cutout portion 41X, which is the width of the upper portion in the front-rear direction, is smaller than the diameter of the circular rod-shaped portions of the operation knob 21 but is slightly larger than the diameter of the slot portion 21R.

Figure 7:
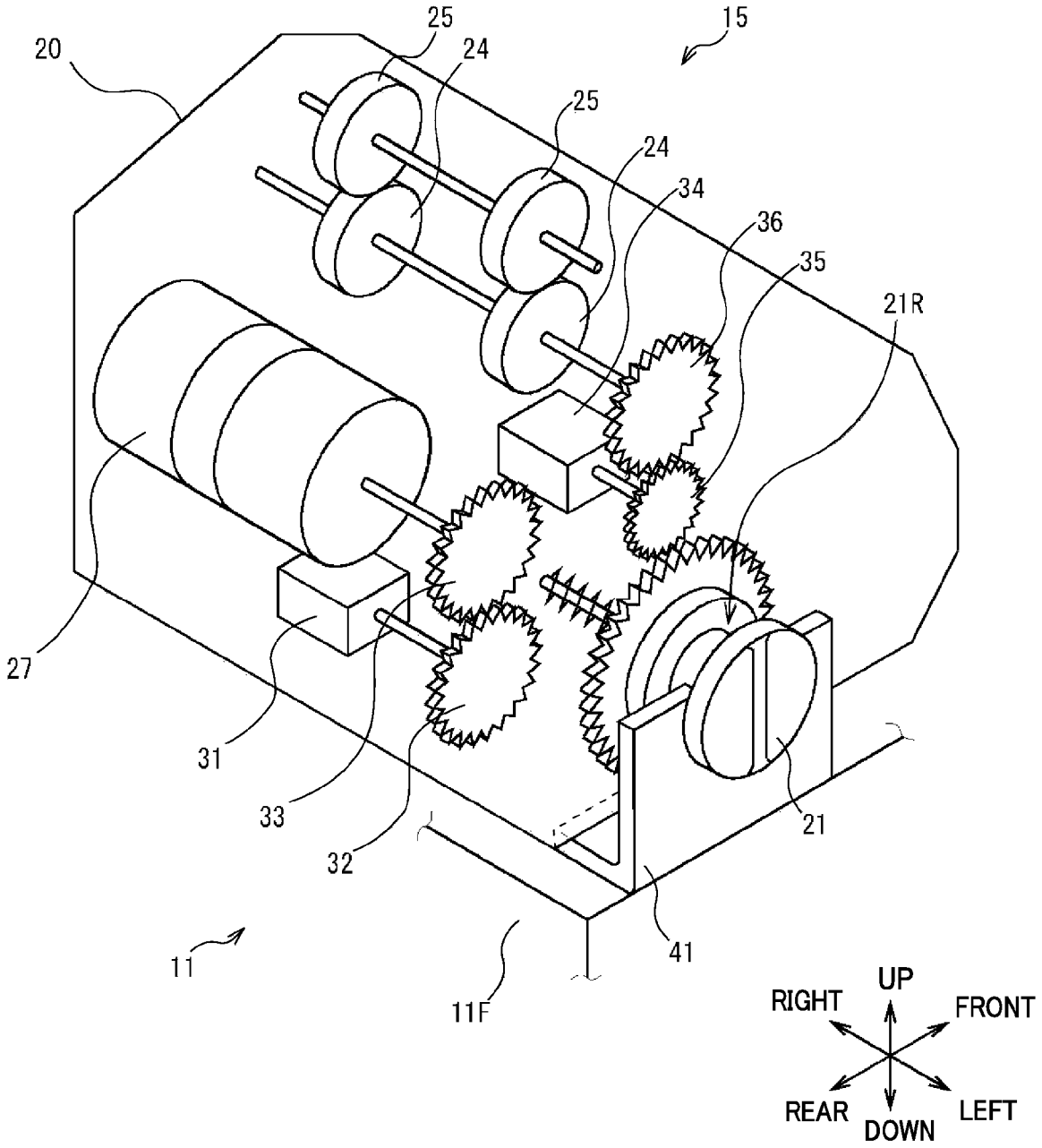
FIG. 7 is a schematic perspective view illustrating a relationship between the operation knob and the operation restriction plate in accordance with the first embodiment.

As illustrated in FIG. 7, the operation restriction plate 41 meshes with the slot portion 21R formed at the operation knob 21 of the temporary holding section 15 when the temporary holding section 15 is in the mounted state.

Figure 8A:
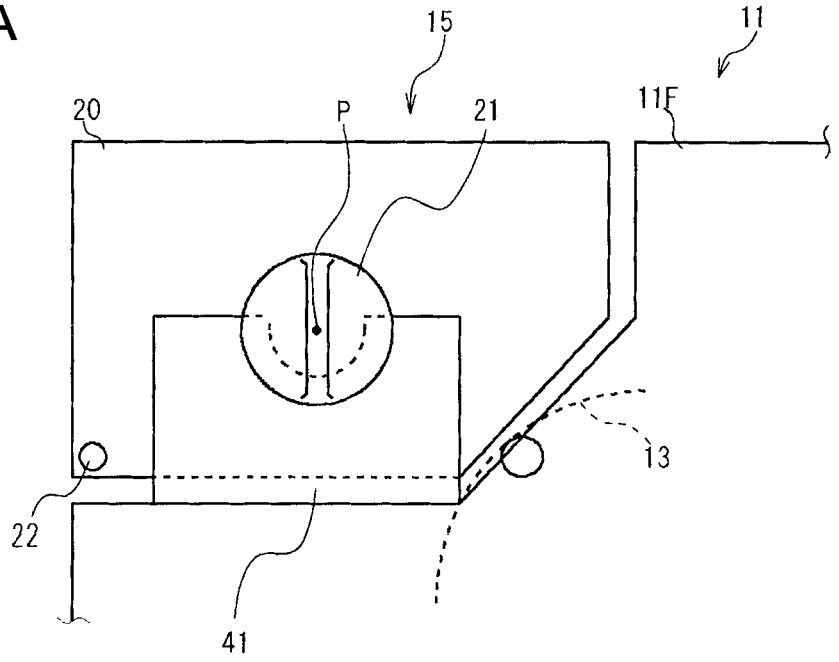
FIG. 8A is a schematic view illustrating the relationship between the operation knob and the operation restriction plate in accordance with the first embodiment when the temporary holding section is in the mounted state.
Figure 9:
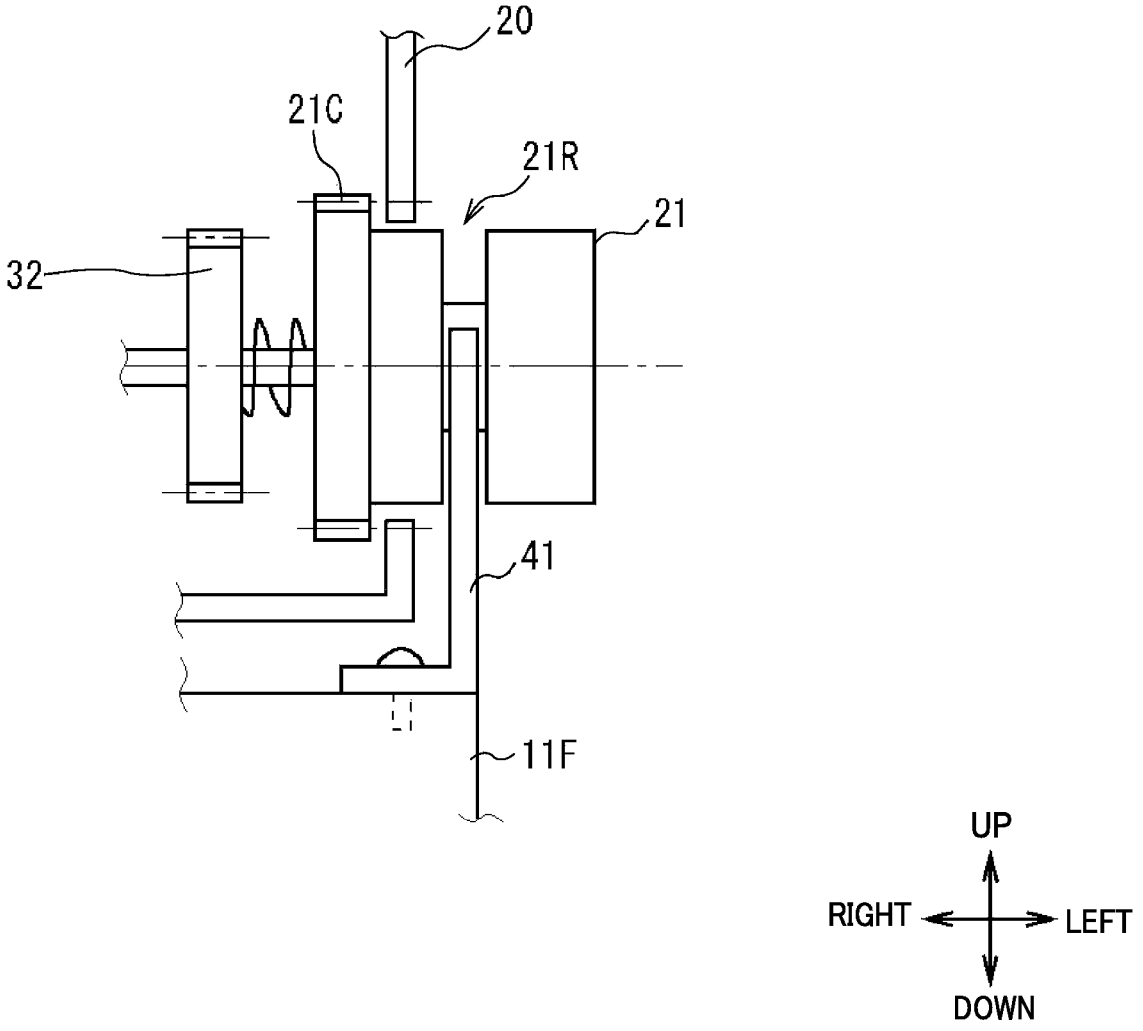
FIG. 9 is a schematic view illustrating the relationship between the operation knob and the operation restriction plate in accordance with the first embodiment.

At the operation restriction plate 41 in this state, as illustrated in FIG. 8A and FIG. 9, the cutout portion 41X is fitted around the slot portion 21R of the operation knob 21 and the slot portion 21R is engaged with the lowest side of the cutout portion 41X, including a portion that may be referred to as "the bottom" of the cutout portion 41X.

Thus, the operation restriction plate 41 impedes movement of the operation knob 21 in the rightward direction, and keeps the operation knob 21 at the withdrawn position, that is a position at which the gear portion 21C does not mesh with either of the gears 32 and 35.

Figure 8B:
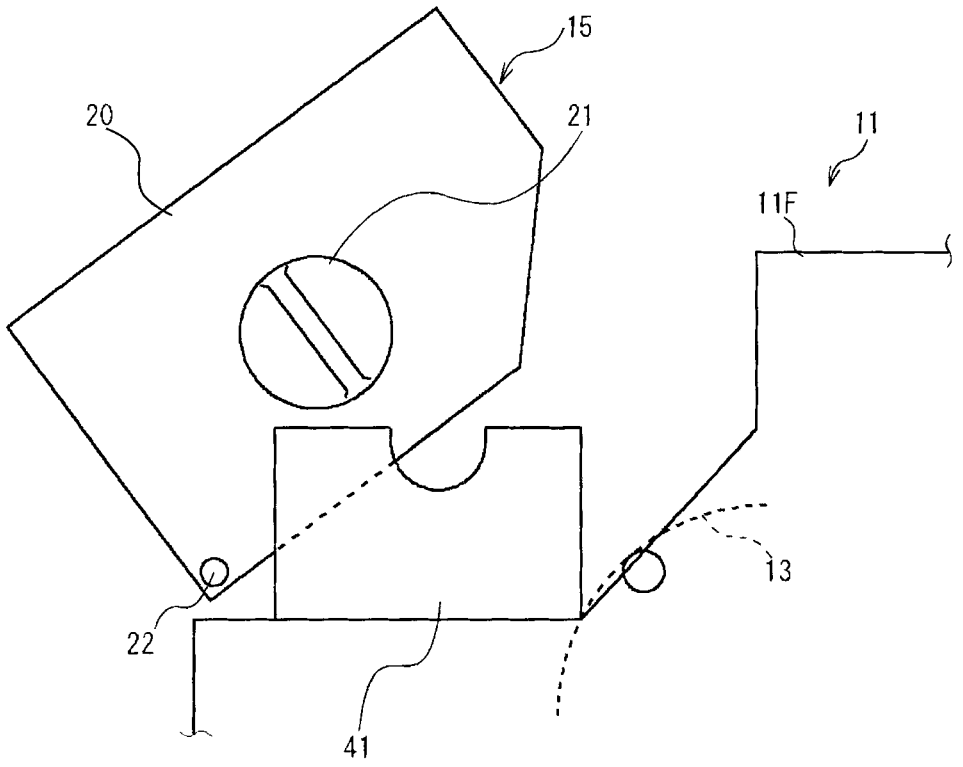
FIG. 8B is a schematic view illustrating the relationship between the operation knob and the operation restriction plate in accordance with the first embodiment when the temporary holding section is in the detached state.

On the other hand, when the temporary holding section 15 is turned from the mounted state in the direction of arrow U1 (FIG. 3) to the detached state, as illustrated in FIG. 8B, the engagement between the cutout portion 41X of the operation restriction plate 41 and the slot portion 21R of the operation knob 21 is released.

In this state, movement of the operation knob 21 in the rightward direction is possible. Therefore, if an external force to the rightward is applied, the operation knob 21 moves to the meshing position and, as illustrated in FIG. 5B, the gear portion 21C may be meshed with the gear 32 and the gear 35.

When the temporary holding section 15 is turned back from the detached state in the direction of arrow U2 (FIG. 3) to the mounted position, the cutout portion 41X of the operation restriction plate 41 is again engaged with the slot portion 21R of the operation knob 21. Thus, movement of the operation knob 21 to the rightward is again impeded and the operation knob 21 is kept at the withdrawn position.

Thus, the operation restriction plate 41 keeps the operation knob 21 at the withdrawn position and impede meshing between the gear portion 21C and the gears 32 and 35, by the cutout portion 41X engaging with the slot portion 21R of the operation knob 21, only when the temporary holding section 15 is in the mounted state.

1-4. Operation and Effects

In the structure described above, the banknote processing section 11 of the ATM 1 according to the first embodiment is configured such that the temporary holding section 15 is turnable relative to the banknote processing section frame 11F, and the slot portion 21R is formed in the operation knob 21.

In the temporary holding section 15, the operation knob 21 is movable between the withdrawn position and the meshing position. The gear portion 21C of the operation knob 21 is not meshed with anything at the withdrawn position, but is meshed with the gear 32 and the gear 35 at the meshing position.

Meanwhile, the operation restriction plate 41 in which the U-shaped cutout portion 41X is formed is provided at the banknote processing section frame 11F. When the temporary holding section 15 is in the mounted state and the transfer aperture 23 is close to the conveyance section 13 of the banknote processing section 11, the cutout portion 41X of the operation restriction plate 41 is engaged with the slot portion 21R of the operation knob 21 (FIG. 7, FIG. 8A and FIG. 9).

When, for example, a maintenance operation is being carried out at the ATM 1, the banknote processing section frame 11F is pulled out to rearward from the casing 2 by an operation of a maintenance technician. At this stage, the temporary holding section 15 is in the mounted state, and the slot portion 21R of the operation knob 21 is engaged with the cutout portion 41X of the operation restriction plate 41.

Therefore, even if an external force in the rightward direction is applied to the operation knob 21 by the maintenance technician, the operation knob 21 may be kept at the withdrawn position (FIG. 5A), and the gear portion 21C does not mesh with the gears 32 and 35.

Thus, the drum 27, the conveyance rollers 24 and the like inside the temporary holding section 15 are not rotated while the temporary holding section 15 is in the mounted state. Therefore, even if banknotes BL are being stored inside the temporary holding section 15, these banknotes BL will not be conveyed.

As a result, situations such as banknotes BL moving to be fed out from the transfer aperture 23 and getting jammed in the conveyance path 26, the drum 27 and tape (not illustrated in the drawings) or the like being damaged by jammed banknotes BL, the jammed banknotes BL themselves being damaged, and so forth may be pre-emptively prevented in the temporary holding section 15.

Because the operation restriction plate 41 is structured by a thick metal plate, even if the maintenance technician forcibly or accidentally applies an external force, there is little danger of the operation restriction plate 41 being deformed or broken, and the operation knob 21 may continue to be kept at the withdrawn position.

Because the cutout portion 41X of the operation restriction plate 41 is formed in a U-shape that is deeper than a semicircle, the slot portion 21R may be engaged over a wide range that extends to a portion at the upper side relative to the rotation axis of the operation knob 21 (marked as point P in FIG. 8A).

Therefore, the operation restriction plate 41 may engage the slot portion 21R from both the front and rear sides, around the rotation axis of the operation knob 21. Thus, the risk of this engagement being easily released due to problems such as positional inaccuracy (due to "looseness" or the like) may be reduced.

Moreover, the likelihood of the cutout portion 41X being capable of engaging with the slot portion 21R of the operation knob 21 may be improved, even if the operation restriction plate 41 is lifted in the upward direction to some extent relative to the banknote processing section frame 11F when the temporary holding section 15 is in the mounted state, due to problems such as positional inaccuracy.

Since the operation restriction plate 41 has a relatively large area as viewed in the left-right direction, when the temporary holding section 15 is in the mounted state, the operation restriction plate 41 is disposed at the left side of the frame 20 and is substantially parallel, with a small gap, with a portion of the frame 20 that forms a left side plate (FIG. 8A and FIG. 9).

Therefore, even if positional accuracy in the left-right direction between the temporary holding section 15 and the banknote processing section frame 11F is poor and the gap between the temporary holding section 15 and the left side plate of the frame 20 is altered, the operation restriction plate 41 abuts against the left side plate of the frame 20, and thus the portion of the operation restriction plate 41 at the left side relative to the slot portion 21R of the operation knob 21 may be kept in a state of protruding to the left side from the frame 20.

On the other hand, when the temporary holding section 15 is turned from the mounted state in the direction of arrow U1 (FIG. 3) to the detached state, the engagement between the slot portion 21R of the operation knob 21 and the cutout portion 41X of the operation restriction plate 41 may be released (FIG. 8B).

That is, simply by the temporary holding section 15 being turned by a maintenance technician in the same manner as in the conventional configuration, for purposes such as improving the efficiency of maintenance operations, exposing the transfer aperture 23 and a portion of the conveyance section 13 and so forth, the blocking of operations of the operation knob 21 may be released.

Thus, only in the detached state in which the transfer aperture 23 is separated from the conveyance section 13 of the banknote processing section 11 and the banknotes BL may be fed out, operation of the operation knob 21 of the temporary holding section 15 is allowed, the operation knob 21 may be moved to the meshing position, the gear portion 21 C may be meshed with the gears 32 and 35, and the drum 27 and the conveyance rollers 24 and the like may be rotated.

In this state, because the gear portion 21C of the operation knob 21 is meshed with both of the gears 32 and 35 that are basically driven independently from one another, rotary operations of the operation knob 21 may be transmitted to both the drum 27 and the conveyance rollers 24 and the like at the same time.

Thus, at the temporary holding section 15, banknotes BL that are wound onto the drum 27 may be fed out just by, for example, a maintenance technician operating the operation knob 21 with one hand, and the maintenance technician may retrieve the banknotes BL with their other hand.

According to the structure described above, in the banknote processing section 11 of the ATM 1, when the temporary holding section 15 is in the mounted state, the cutout portion 41X of the operation restriction plate 41 is engaged with the slot portion 21R of the operation knob 21 and is retained at the withdrawn position. Thus, the gear portion 21C is not meshed with anything, and rotary operations of the drum 27, the conveyance rollers 24 and the like may be restricted. On the other hand, when the temporary holding section 15 at the banknote processing section 11 is turned to the detached state, the engagement between the cutout portion 41X of the operation restriction plate 41 and the slot portion 21R of the operation knob 21 is released. Hence, the operation knob 21 of the temporary holding section 15 may be moved from the withdrawn position to the meshing position, the gear portion 21C may be meshed with the gear 32 and the gear 35, and rotary operations of the drum 27, the conveyance rollers 24 and the like via the operation knob 21 may be enabled.

2. Second Embodiment

An ATM 101 according to a second embodiment differs from the ATM 1 according to the first embodiment (FIG. 1 and FIG. 2) in including a banknote processing section 111 instead of the banknote processing section 11, but other portions have the same structures.

The banknote processing section 111 differs from the banknote processing section 11 according to the first embodiment in including a temporary holding section 115 and an operation restriction plate 141 instead of the temporary holding section 15 and the operation restriction plate 41, but other portions have the same structures.

2-1. Structure of the Temporary Holding Section

The temporary holding section 115 differs from the temporary holding section 15 according to the first embodiment (FIG. 3 to FIG. 9) in including an operation knob 121 instead of the operation knob 21, but other portions have the same structures.

Figure 10:
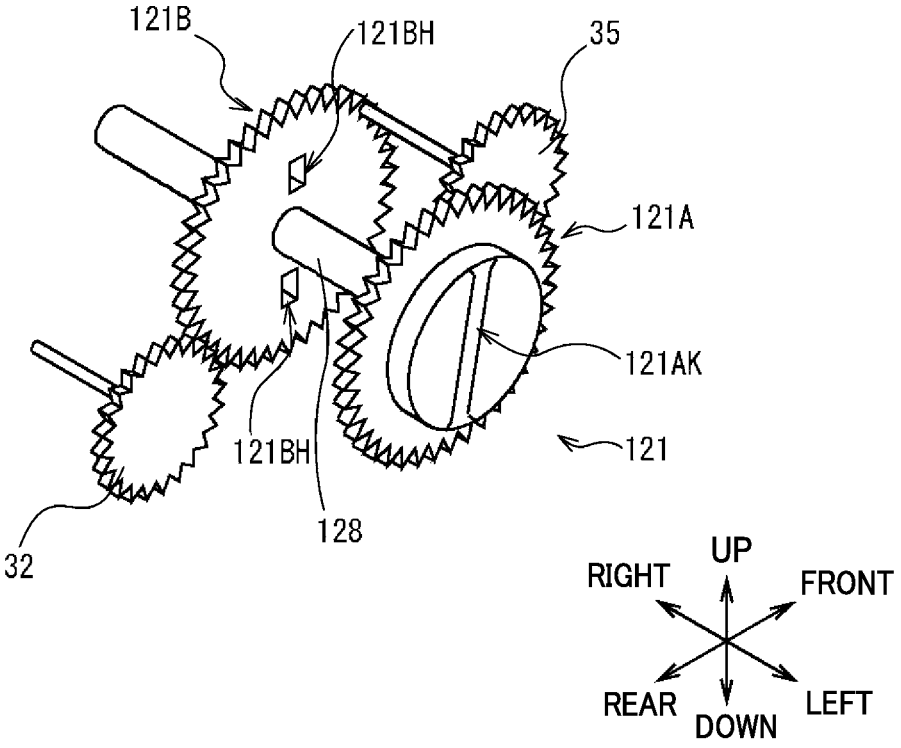
FIG. 10 is a schematic perspective view illustrating the structure of an operation knob in accordance with a second embodiment.
Figure 11A:
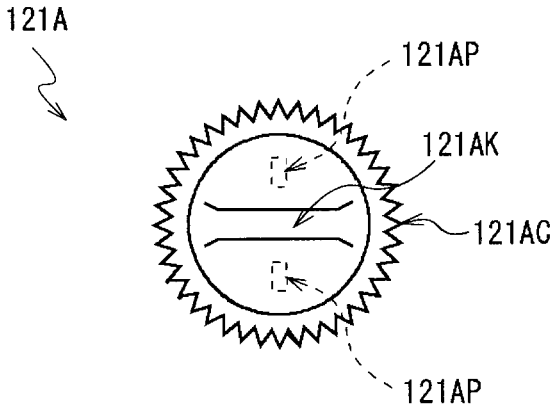
FIG. 11A is a schematic view illustrating the structure of a first gear of the operation knob in accordance with the second embodiment.
Figure 11B:
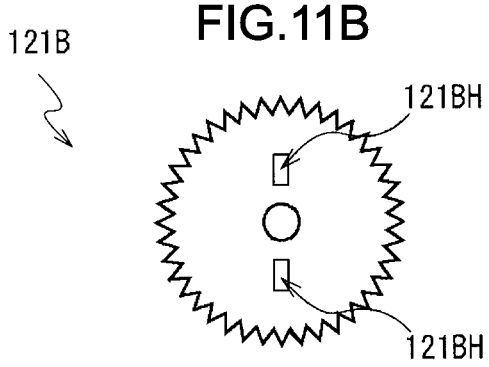
FIG. 11B is a schematic view illustrating the structure of a second gear of the operation knob in accordance with the second embodiment.

As illustrated in FIG. 10, FIG. 11A and FIG. 11B, the operation knob 121 is structured with a first gear 121A and a second gear 121B.

The first gear 121A has a structure in which a thin disc-shaped member and a spur gear are superposed such that central axes thereof are aligned with one another. The first gear 121A is mounted to a shaft 128 so that the central axis is also aligned with the shaft 128. A grip 121AK is formed by a left face of the disc-shaped part of the first gear 121A being indented into a predetermined shape.

Figure 12A:
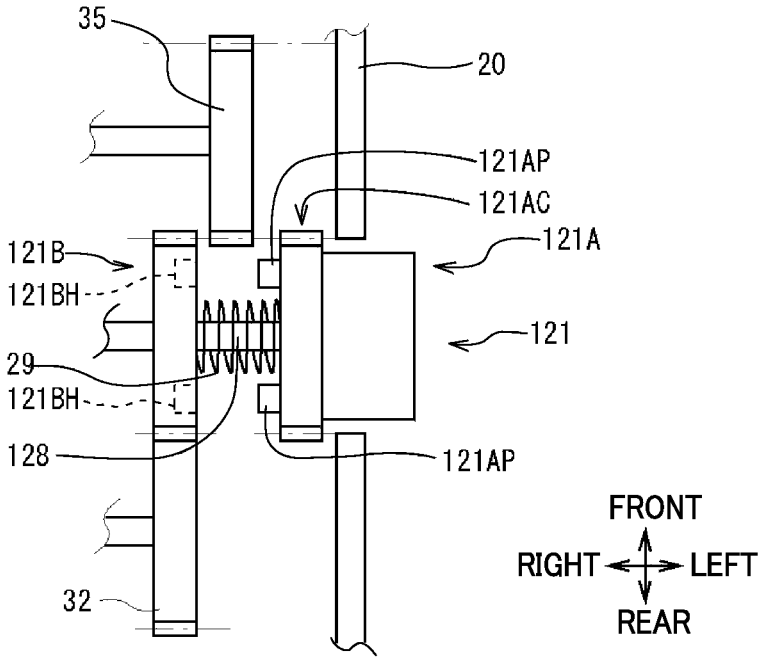
FIG. 12A is a schematic view illustrating the structure when the first gear of the operation knob in accordance with the second embodiment is at a separated position.

As illustrated in FIG. 12A, small square rod-shaped protrusions 121AP protruding to the rightward are provided at a right side face of a gear part 121AC of the first gear 121A. The protrusions 121AP are provided at two locations opposing one another from either side of the central axis of the first gear 121A.

The second gear 121B is a spur gear, as illustrated in FIG. 11B, and is fitted around the shaft 128. Hole portions 121BH are bored at a left side face of the second gear 121B, at positions respectively corresponding with the two protrusions 121AP of the first gear 121A. The hole portions 121BH are square holes slightly larger than the protrusions 121AP.

As illustrated in FIG. 12A, the second gear 121B is continuously meshed with the gear 32. The gear 35 is disposed slightly left side relative to the second gear 121B, such that the gear 35 does not mesh with the second gear 121B.

The shaft 128 supports the second gear 121B to be rotatable but not to move in the left-right direction. Meanwhile, the shaft 128 supports the first gear 121A to be rotatable and, by a portion of the shaft 128 being compressed, movable rightward until the first gear 121A abuts against the second gear 121B.

The spring 29 is fitted around the shaft 128, between the first gear 121A and the second gear 121B, in a state in which the spring 29 is compressed from the natural length thereof.

According to this structure, in a state in which no external force is applied, the first gear 121A of the operation knob 121 is urged leftward by the urging force of the spring 29 and, as illustrated in FIG. 12A, the first gear 121A is in a state of being disposed at a leftmost side and separated from the second gear 121B. Hereinafter, the position of the first gear 121A in this state is referred to as "the separated position".

In this state, the gear part 121AC of the first gear 121A does not mesh with any of the gears and is in a free state. Meanwhile, the second gear 121B meshes with the gear 32 but is separated from the first gear 121A.

Therefore, even if the first gear 121A of the operation knob 121 is rotated, the second gear 121B and any other gears cannot be rotated. Thus, the operation knob 121 is rotated without effect.

Figure 12B:
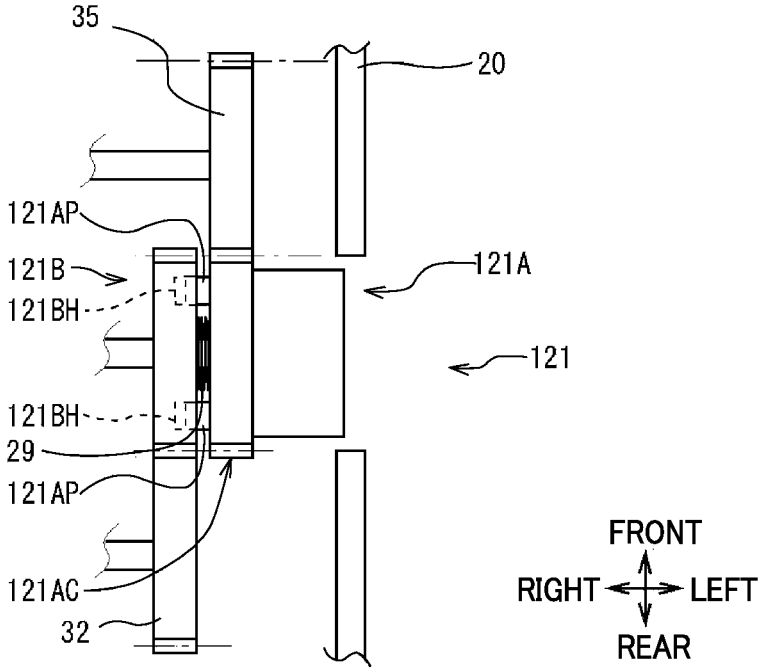
FIG. 12B is a schematic view illustrating the structure when the first gear of the operation knob in accordance with the second embodiment is at a joining position.

On the other hand, when an external force is applied to the first gear 121A of the operation knob 121, such as when the operation knob 121 is pushed into the rightward, the first gear 121A moves rightward while compressing the spring 29 and, as illustrated in FIG. 12B, goes into a state in which the protrusions 121AP are fitted into the hole portions 121BH and the first gear 121A is joined to the second gear 121B. Hereinafter, the position of the first gear 121A in this state is referred to as "the joining position".

At the operation knob 121, if the first gear 121A is simply moved to the rightward, the positions of the protrusions 121AP and the hole portions 121BH of the second gear 121B may not match up and the protrusions 121AP and hole portions 121BH may not be joined. In this case, the protrusions 121AP may be fitted into the hole portions 121BH by the first gear 121A of the operation knob 121 being suitably rotated while being pushed into the rightward.

In this state, the gear part 121AC of the first gear 121A is meshed with the gear 35, while the second gear 121B is continuously meshed with the gear 32. If a rotary force about the shaft 128 is further applied to the first gear 121A, the rotary force may be transmitted via the protrusions 121AP to the second gear 121B.

Therefore, when the first gear 121A of the operation knob 121 is rotated, the second gear 121B rotates integrally therewith. Thus, driving force is transmitted to both the gear 32 and the gear 35 and, the same as in the first embodiment, the drum 27 and the conveyance rollers 24 and driven rollers 25 may be rotated simultaneously.

From the joining position, when the external force to rightward is released, the first gear 121A of the operation knob 121 is moved in the leftward direction by the restoring force of the spring 29, and returns to the separated position (FIG. 12A).

Thus, the temporary holding section 115 is structured such that, during usual operations, the first gear 121A of the operation knob 121 is retained at the separated position and is separated from the gears 32 and 35. On the other hand, during maintenance operations, if the first gear 121A is pushed into the joining position, rotary driving force may be transmitted from the operation knob 121 to the gears 32 and 35.

2-2. Structure of the Operation Restriction Plate

Figure 13:
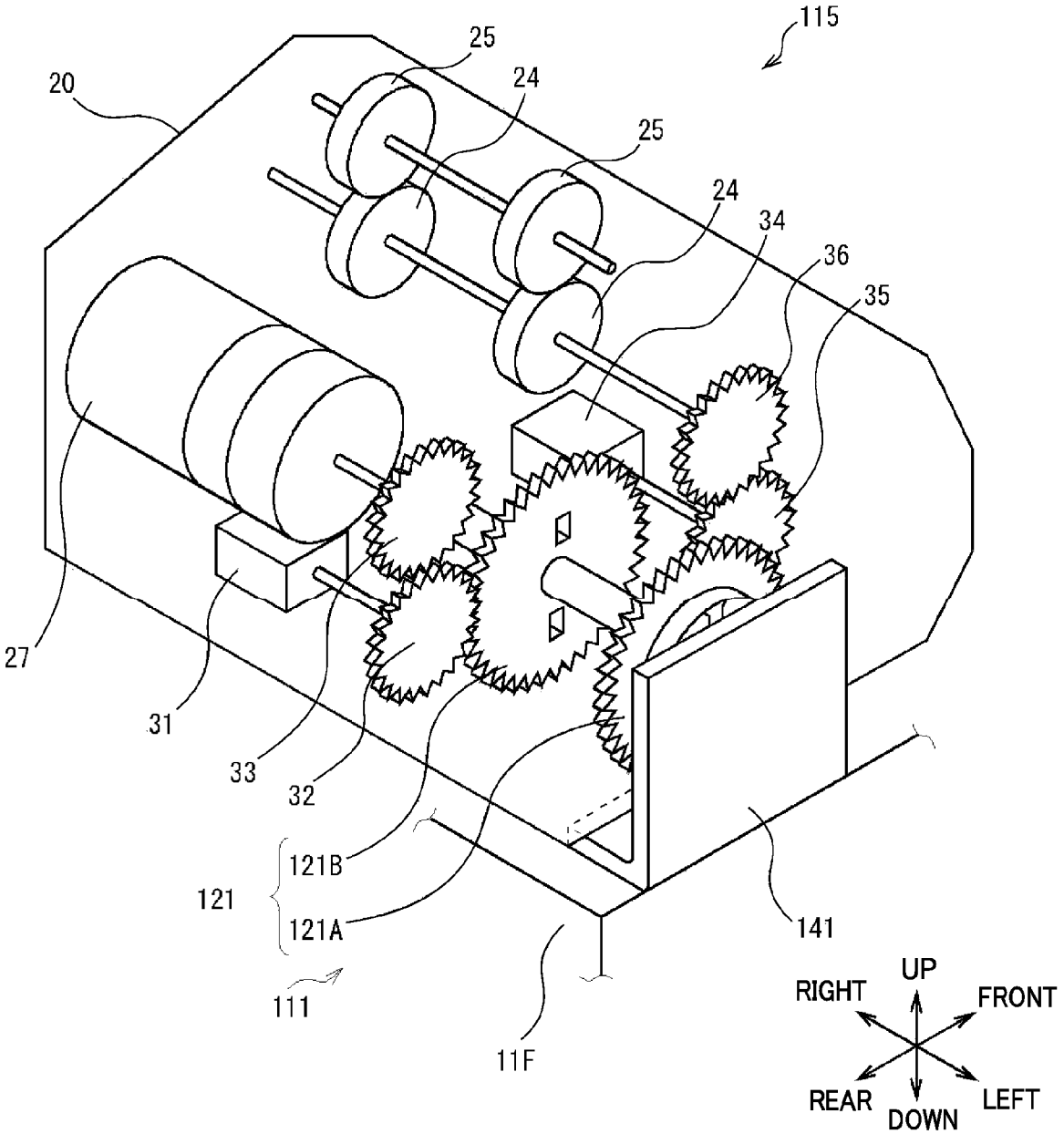
FIG. 13 is a schematic perspective view illustrating a relationship between the operation knob and an operation restriction plate in accordance with the second embodiment.

At the operation restriction plate 141, as illustrated in FIG. 13, the cutout portion 41X of the operation restriction plate 41 according to the first embodiment is omitted, and the operation restriction plate 141 is in a shape that is elongated upward.

Figure 14A:
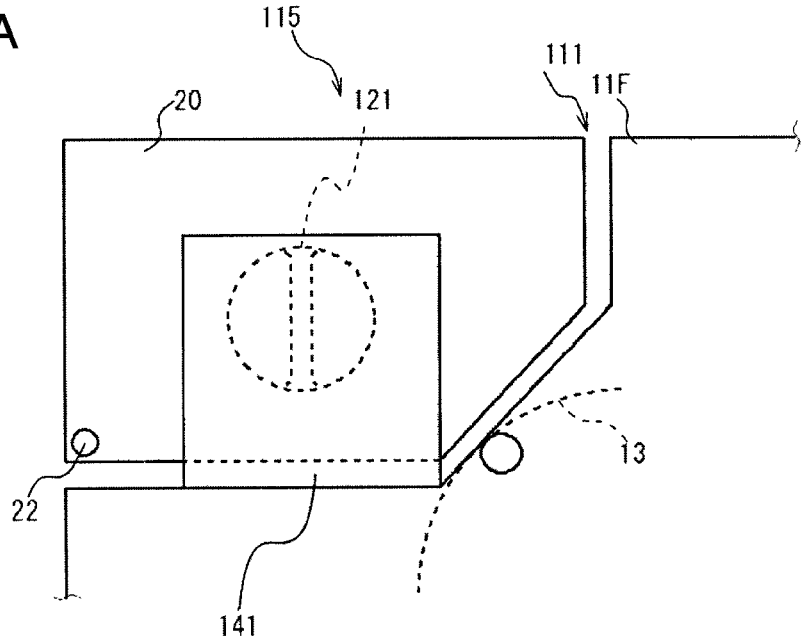
FIG. 14A is a schematic view illustrating the relationship between the operation knob and the operation restriction plate in accordance with the second embodiment when the temporary holding section is in the mounted state.
Figure 15:
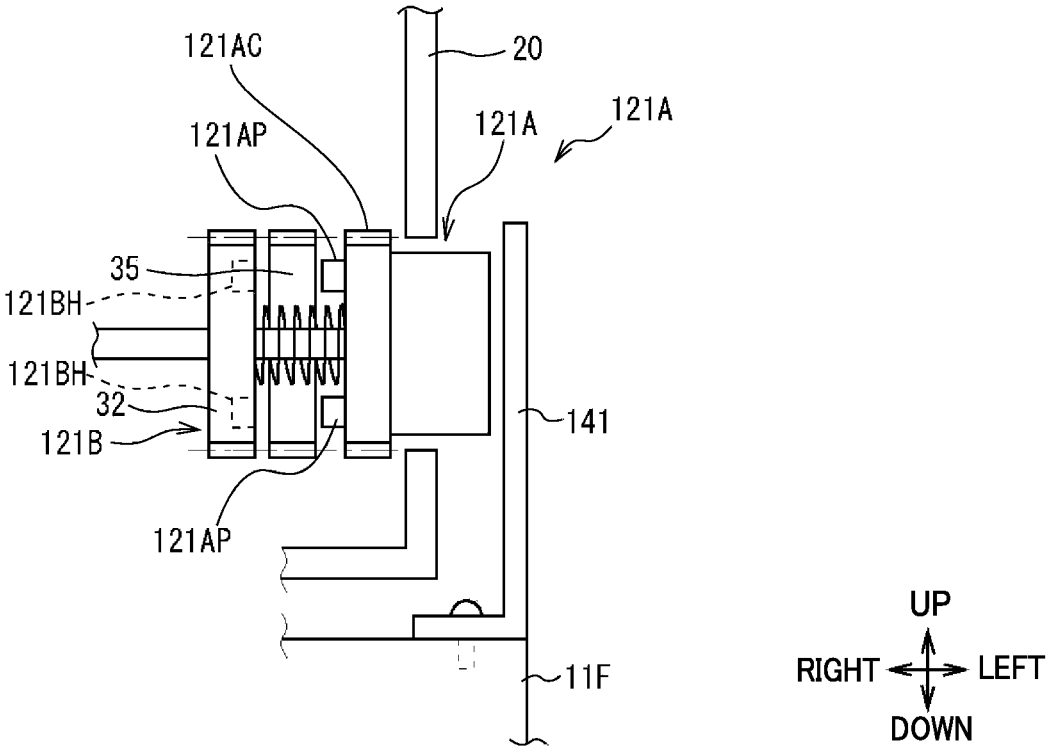
FIG. 15 is a schematic view illustrating the relationship between the operation knob and the operation restriction plate in accordance with the second embodiment.

As illustrated in FIG. 14A and FIG. 15, the operation restriction plate 141 is formed so as to cover the first gear 121 A of the operation knob 121 when the temporary holding section 115 is in the mounted state.

Thus, the operation restriction plate 141 may be an obstruction such that the first gear 121A of the operation knob 121 cannot be operated by a maintenance technician. That is, the operation restriction plate 141 impedes movement of the first gear 121A in the rightward direction, and keeps the first gear 121A at the separated position, that is, in the state in which the first gear 121A is not joined to the second gear 121B and the gear part 121AC is not meshed with the gear 35.

Figure 14B:
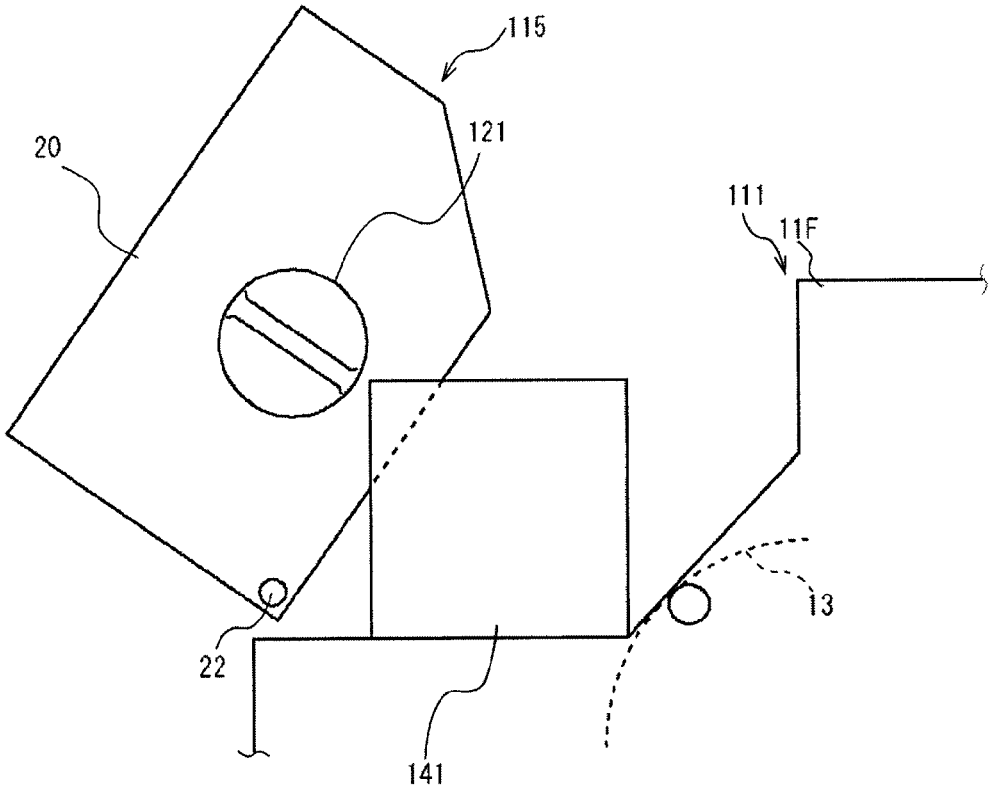
FIG. 14B is a schematic view illustrating the relationship between the operation knob and the operation restriction plate in accordance with the second embodiment when the temporary holding section is in the detached state.

On the other hand, as illustrated in FIG. 14B, when the temporary holding section 115 is turned from the mounted state in the direction of arrow U1 (FIG. 3) to the detached state, the first gear 121A of the operation knob 121 is exposed from the operation restriction plate 141.

In this state of the operation knob 121, operation of the first gear 121A by a maintenance technician is possible. Thus, if an external force to the rightward is applied, the first gear 121A may be moved to the joining position and, as illustrated in FIG. 12B, the first gear 121A may be joined with the second gear 121B and the gear part 121AC may be meshed with the gear 35

When the temporary holding section 115 is turned back from the detached state in the direction of arrow U2 (FIG. 3) to the mounted position, the operation restriction plate 141 again covers the first gear 121A of the operation knob 121. Thus, the operation restriction plate 141 impedes operations of the first gear 121A such as pushing in, rotating and the like, and the first gear 121A is kept at the separated position.

Thus, the operation restriction plate 141 is structured to keep the first gear 121A at the separated position and to impede joining with the second gear 121B and meshing between the gear part 121AC and the gear 35 by the operation restriction plate 141 covering the first gear 121A of the operation knob 121 only when the temporary holding section 115 is in the mounted state.

2-3. Operation and Effects

In the structure described above, the banknote processing section 111 of the ATM 101 according to the second embodiment is configured such that the temporary holding section 115 is structured to be turnable relative to the banknote processing section frame 11F, and the operation knob 121 is structured with the first gear 121A and second gear 121B that are joined to or separated from one another.

In the temporary holding section 115, the first gear 121A of the operation knob 121 is movable between the separated position and the joining position. When the first gear 121A is at the joining position, the first gear 121A is joined to the second gear 121B and the gear part 121AC is meshed with the gear 35.

When the temporary holding section 115 is at the mounted position, the operation restriction plate 141 mounted at the banknote processing section frame 11F covers the first gear 121A of the operation knob 121 (FIG. 13, FIG. 14A and FIG. 15).

Therefore, at the temporary holding section 115, a maintenance technician may be prevented from touching the first gear 121A of the operation knob 121, and the first gear 121A may be kept at the separated position.

Thus, the same as in the first embodiment, the drum 27, the conveyance rollers 24 and the like inside the temporary holding section 115 are not rotated while the temporary holding section 115 is in the mounted state. Therefore, even if banknotes BL are being stored inside the temporary holding section 115, these banknotes BL are not conveyed.

As a result, the same as in the first embodiment, situations such as banknotes BL moving to be fed out through the transfer aperture 23 and getting jammed in the conveyance path 26, the drum 27 and tape (not illustrated in the drawings) or the like being damaged by jammed banknotes BL, the jammed banknotes BL themselves being damaged, and so forth may be pre-emptively prevented in the temporary holding section 115.

Because the operation restriction plate 141 is structured by a thick metal plate, even if a maintenance technician forcibly or accidentally applies an external force, there is little danger of the operation restriction plate 141 being deformed or broken, and the first gear 121A of the operation knob 121 may continue to be kept at the withdrawn position.

On the other hand, when the temporary holding section 115 is turned from the mounted state in the direction of arrow U1 (FIG. 3) to the detached state, the first gear 121A of the operation knob 121 may be exposed from behind the operation restriction plate 141 (FIG. 14B).

Thus, only in the detached state in which the transfer aperture 23 is separated from the conveyance section 13 of the banknote processing section 111 and the banknotes BL may be fed out, operation of the operation knob 121 of the temporary holding section 115 is allowed, the first gear 121A may be moved to the joining position and joined to the second gear 121B, the gear part 121AC may be meshed with the gear 35, and the drum 27 and the conveyance rollers 24 and the like may be rotated.

According to the structure described above, in the banknote processing section 111 of the ATM 101, when the temporary holding section 115 is in the mounted state, the first gear 121A of the operation knob 121 is covered by the operation restriction plate 141 and retained at the separated position. Thus, driving force is not transmitted to the gears 32 and 35, and rotary operations of the drum 27, the conveyance rollers 24 and the like may be restricted. On the other hand, when the temporary holding section 115 of the banknote processing section 111 is turned to the detached state, the first gear 121A of the operation knob 121 is exposed from behind the operation restriction plate 141. Thus, the first gear 121A of the operation knob 121 of the temporary holding section 115 may be moved from the separated position to the joining position, the first gear 121A may be joined to the second gear 121B2 and the gear part 121AC may be meshed with the gear 35, and rotary operations of the drum 27, the conveyance rollers 24 and the like via the operation knob 121 may be enabled.

3. Alternative Embodiments

In the first embodiment described above, a case is described in which the cutout portion 41X of the operation restriction plate 41 is formed in a U shape as viewed in the left-right direction.

However, embodiments are not limited thus. The shape of the cutout portion may be a variety of shapes such as, for example, a crank shape, a V shape, a shape with multiple sides. In these cases, it is sufficient that the operation knob 21 may be retained at the withdrawn position by reliable engagement of the cutout portion with the slot portion 21R of the operation knob 21 when the temporary holding section 15 is in the mounted state.

In the first embodiment described above, a case is described in which the portion of the operation restriction plate 41 extending upward from the upper face of the banknote processing section frame 11F is formed in a plate shape.

However, embodiments are not limited thus. For example, a rod-shaped member may be machined and formed into a Y shape, a V shape or the like as viewed in the left-right direction. That is, it is sufficient that the operation restriction plate 41 reliably engages with the slot portion 21R of the operation knob 21 only when the temporary holding section 15 is in the mounted state, and is strong enough to not be easily deformed.

In the first embodiment described above, a case is described in which the slot portion 21R is formed at the operation knob 21 and the slot portion 21R is engaged with the cutout portion 41X of the operation restriction plate 41.

However, embodiments are not limited thus. For example, the slot portion 21R may be omitted from the operation knob 21, the diameter of the semi-circular portion of the cutout portion 41X may be made slightly larger than the outer diameter of the shaft 28, and the cutout portion 41X may be engaged with the vicinity of a location of the connection between the operation knob 21 and the shaft 28.

In the first embodiment described above, a case is described in which an upper end portion of the operation restriction plate 41 reaches the upper side relative to point P, the axial center of the operation knob 21, when the cutout portion 41X of the operation restriction plate 41 is engaged with the slot portion 21R of the operation knob 21, and the middle of the operation knob 21 is sandwiched and engaged from both sides.

However, embodiments are not limited thus. The upper end portion of the operation restriction plate 41 may stop at the lower side relative to the axial center point P of the operation knob 21 when the cutout portion 41X of the operation restriction plate 41 is engaged with the slot portion 21R of the operation knob 21.

In the second embodiment described above, a case is described in which the operation knob 121 is completely covered by the operation restriction plate 141 when the temporary holding section 115 is in the mounted state.

However, embodiments are not limited thus. For example, a portion of the operation knob 121 may be exposed from the operation restriction plate 141 when the temporary holding section 115 is in the mounted state. In this case, it is sufficient that the operation knob 121 may be impeded such that a maintenance technician may not push in the first gear 121A of the operation knob 121 and the first gear 121A may not be joined to the second gear 121B.

Cases are described above in which, in the first embodiment, the operation knob 21 is integrally structured, and in the second embodiment, the operation knob 121 is structured with the first gear 121A and the second gear 121B being separable.

However, embodiments are not limited thus. For example, in the first embodiment, the operation knob 21 may be structured to be separable similarly to the second embodiment, and in the second embodiment, the operation knob 121 may be integrally structured similarly to the first embodiment.

In the first embodiment described above, a case is described in which, when the operation knob 21 is moved to the meshing position, the operation knob 21 meshes with both the gear 32 for driving the drum 27 and the gear 35 for driving the conveyance rollers 24 and the like.

However, embodiments are not limited thus. When the operation knob 21 is moved to the meshing position, it may mesh with only one of the gear 32 and the gear 35, or may mesh with three or more gears. The same applies to the second embodiment.

In the second embodiment described above, a case is described in which the number of the protrusions 121AP provided at the first gear 121A and the number of the hole portions 121BH provided at the second gear 121B are both two.

However, embodiments are not limited thus. For example, the numbers of the protrusions 121AP and hole portions 121BH may be arbitrary numbers, such as both being four, six or the like. Furthermore, the number of the protrusions 121AP may be smaller than the number of the hole portions 121BH.

In the first embodiment described above, a case is described in which rotary force is transmitted by gears meshing with one another, meshing between the gear portion 21C of the operation knob 21 and the gears 32 and 35 or the like.

However, embodiments are not limited thus. For example, rubber members or the like with large friction forces may be installed at outer peripheries of disc-shaped members and rotary force may be transmitted by these disc-shaped members abutting against one another. That is, it is sufficient that a rotary force applied via the operation knob be transmitted to another member. The same applies to the second embodiment.

In the first embodiment described above, a case is described in which the temporary holding section 15 is switched to the mounted state or the detached state by being turned about the turning shaft 22 relative to the banknote processing section frame 11F of the banknote processing section 11.

However, embodiments are not limited thus. For example, the temporary holding section 15 may be switched to the mounted state or the detached state by being slid along a predetermined slide rail relative to the banknote processing section frame 11F. In this case, it is sufficient that a direction of formation of the cutout portion 41X corresponds with the direction of movement of the temporary holding section 15. The same applies to the second embodiment.

In the first embodiment described above, a case is described in which the present invention is applied to the temporary holding section 15 that temporarily retains banknotes BL.

However, embodiments are not limited thus. For example, the present invention may be applied to various sections in the ATM 1, such as a portion of the conveyance section 13, the banknote storage section 12 or the banknote storages 17. In these cases, it is sufficient that section is structured to be mountable and detachable relative to the banknote processing section frame 11F or the like and includes an operation knob for maintenance operations, and, by an operation restriction plate that is provided at the banknote processing section frame 11F or the like, feeding operations of banknotes BL by the operation knob are restricted in a state in which that section is mounted and such operations by the operation knob are allowed in a state in which that section is detached. The same applies to the second embodiment.

In the first embodiment described above, a case is described in which the medium is banknotes being stored at the temporary holding section 15 of the ATM 1.

However, embodiments are not limited thus. For example, the present invention may be applied to a variety of devices storing, for example, paper-form media such as merchandise coupons, money certificates or event tickets, or a medium such as coins. The same applies to the second embodiment.

In the first embodiment described above, a case is described in which the banknote processing section 11 serving as a medium processing device is structured by the temporary holding section 15 serving as a temporary holding section, the gears 32 and 35 serving as gears, the banknote processing section frame 11F serving as a main body, the operation knob 21 serving as an operation knob, and the operation restriction plate 41 serving as an operation restriction portion.

However, embodiments are not limited thus. The medium processing device may be structured by a temporary holding section, gear(s), main body, operation knob and operation restriction portion that have numerous alternative structures.

INDUSTRIAL APPLICABILITY

The present invention may be employed in automatic teller machines that perform transactions relating to cash including banknotes.

The invention claimed is:

1. A medium processing device, comprising:

a temporary holding section that temporarily retains a medium therein, the temporary holding section including a mechanism that stores the medium into the temporary holding section and feeds out the medium from inside the temporary holding section;

a gear that is provided inside the temporary holding section, and that drives the mechanism;

a main body that includes a mounting location at which the temporary holding section is mounted, and that transfers the medium to and from the temporary holding section at a time at which the temporary holding section is mounted at the mounting location;

an operation knob that transmits, to the gear, a rotary operation applied from outside of the temporary holding section; and an operation restriction portion that is provided at the main body, that blocks transmission of the rotary operation from the operation knob to the gear in a mounted state in which the temporary holding section is mounted at the mounting location of the main body, and that allows transmission of the rotary operation from the operation knob to the gear in a detached state in which the temporary holding section is detached from the mounting location, wherein in the mounted state, the operation restriction portion engages with the operation knob at a plurality of locations around a rotation axis of the operation knob.

2. The medium processing device according to claim 1, wherein:

the operation knob includes a gearwheel, the gearwheel of the operation knob meshing with the gear by being moved to a predetermined meshing position, and the meshing of the gear and the gearwheel being released by the operation knob being moved to a withdrawn position that is distant from the meshing position; and the operation restriction portion blocks the transmission of the rotary operation from the operation knob to the gear in the mounted state by keeping the operation knob at the withdrawn position, and allows movement of the operation knob to the meshing position in the detached state.

3. The medium processing device according to claim 2, wherein the operation restriction portion keeps the operation knob at the withdrawn position in the mounted state by engaging with the operation knob in the plurality of locations.

4. The medium processing device according to claim 2, wherein the operation restriction portion keeps the operation knob at the withdrawn position in the mounted state by being disposed between the withdrawn position and the meshing position of the operation knob.

5. The medium processing device according to claim 1, wherein the mechanism includes:

a drum, on a peripheral face of which the medium is wound; and a conveyance section that conveys the medium between the drum and the main body, the gear includes:

a drum gear that transmits driving force from a predetermined drum motor to the drum; and a conveyance gear that transmits driving force from a predetermined conveyance motor to the conveyance section without transmitting driving force from the drum motor, during non-operation of the operation knob while the rotary operation is not being applied from outside the temporary holding section, the operation knob does not transmit the rotary operation to the drum gear and/or the conveyance gear, and, during operation of the operation knob while the rotary operation is being applied from outside the temporary holding section and the temporary holding section is detached from the mounting location in the detached state, the operation knob transmits rotary operation to both the drum gear and the conveyance gear.

6. The medium processing device according to claim 1, wherein the operation knob includes a slot portion, wherein in the mounted state, the operation restriction portion includes a cutout portion that the slot portion is inserted into so that the operation restriction portion engages with the operation knob at the plurality of locations around the rotation axis of the operation knob.

7. The medium processing device according to claim 6, wherein the slot portion has a smaller diameter than another portion of the operation knob.

8. The medium processing device according to claim 6, wherein the cutout portion is u-shaped.

9. A medium processing device, comprising:

a temporary holding section that temporarily retains a medium therein, the temporary holding section including a mechanism that stores the medium into the temporary holding section and feeds out the medium from inside the temporary holding section;

a gear that is provided inside the temporary holding section, and that drives the mechanism;

a main body that includes a mounting location at which the temporary holding section is mounted, and that transfers the medium to and from the temporary holding section at a time at which the temporary holding section is mounted at the mounting location;

an operation knob that transmits, to the gear, a rotary operation applied from outside of the temporary holding section, the operation knob including a slot portion; and an operation restriction portion that is provided at the main body, that blocks transmission of the rotary operation from the operation knob to the gear in a mounted state in which the temporary holding section is mounted at the mounting location of the main body, and that allows transmission of the rotary operation from the operation knob to the gear in a detached state in which the temporary holding section is detached from the mounting location, and wherein in the mounted state, the operation restriction portion includes a cutout portion that the slot portion is inserted into so that the operation restriction portion engages with the operation knob.

10. The medium processing device according to claim 9, wherein the slot portion has a smaller diameter than another portion of the operation knob.

11. The medium processing device according to claim 9, wherein the cutout portion is u-shaped.

* * * * *